US010370902B2

(12) United States Patent
Hadi

(10) Patent No.: US 10,370,902 B2
(45) Date of Patent: Aug. 6, 2019

(54) DOWNHOLE STEERING CONTROL APPARATUS AND METHODS

(71) Applicant: Nabors Drilling Technologies USA, Inc., Houston, TX (US)

(72) Inventor: Mahmoud Hadi, Richmond, TX (US)

(73) Assignee: NABORS DRILLING TECHNOLOGIES USA, INC., Houston, TX (US)

( * ) Notice: Subject to any disclaimer, the term of this patent is extended or adjusted under 35 U.S.C. 154(b) by 147 days.

(21) Appl. No.: 15/478,724

(22) Filed: Apr. 4, 2017

(65) Prior Publication Data

US 2018/0283158 A1 Oct. 4, 2018

(51) Int. Cl.

| | |
|---|---|
| ***E21B 7/04*** | (2006.01) |
| ***E21B 44/00*** | (2006.01) |
| *E21B 4/02* | (2006.01) |

(52) U.S. Cl.

CPC ..... *E21B 7/046* (2013.01); *E21B 44/00* (2013.01); *E21B 4/02* (2013.01)

(58) Field of Classification Search

CPC ..... E21B 44/00; E21B 7/046; E21B 41/0092; E21B 47/04; E21B 4/02

See application file for complete search history.

(56) References Cited

U.S. PATENT DOCUMENTS

| | | | | |
|---|---|---|---|---|
| 5,852,235 | A | 12/1998 | Pavone et al. | |
| 6,050,348 | A | 4/2000 | Richardson et al. | |
| 2011/0186353 | A1* | 8/2011 | Turner | G05B 13/048 175/40 |
| 2013/0319764 | A1* | 12/2013 | Schaaf | E21B 7/06 175/24 |
| 2015/0107899 | A1 | 4/2015 | Fisher, Jr. et al. | |

* cited by examiner

*Primary Examiner* — Brad Harcourt

(74) *Attorney, Agent, or Firm* — Haynes and Boone, LLP

(57) ABSTRACT

Methods and apparatus for toolface control are disclosed herein. Such toolface controls may be provided responsive to measurement-while-drilling (MWD) data. A dynamic model of the drilling apparatus may be constructed and estimations of one or more characteristics of the drilling apparatus (e.g., toolface orientation) may be determined from the dynamic model. MWD data may be periodically received and an error factor may be determined from the estimation and the MWD data. The dynamic model may be adjusted and an updated estimation may be determined from the updated dynamic model. Data from the determinations using the dynamic model and/or the updated dynamic model may be used to control operation of the drilling apparatus and adjust one or more operational parameters of the drilling apparatus responsive to updated estimations.

21 Claims, 8 Drawing Sheets

DOWNHOLE STEERING CONTROL APPARATUS AND METHODS

FIELD OF THE DISCLOSURE

The present apparatus, methods, and system relate to apparatuses, systems, and methods for directional drilling, and more specifically, to automated directional drilling utilizing measurement-while-drilling data.

BACKGROUND

Subterranean "sliding" drilling operation typically involves rotating a drill bit on a downhole motor at the remote end of a drill pipe string. Drilling fluid forced through the drill pipe rotates the motor and bit. The assembly is directed or "steered" from a vertical drill path in any number of directions, allowing the operator to guide the wellbore to desired underground locations. For example, to recover an underground hydrocarbon deposit, the operator may drill a vertical well to a point above the reservoir and then steer the wellbore to drill a deflected or "directional" well that penetrates the deposit. The well may pass horizontally through the deposit. Friction between the drill string and the bore generally increases as a function of the horizontal component of the bore, and slows drilling by reducing the force that pushes the bit into new formations.

Such directional drilling requires accurate orientation of a bent segment of the downhole motor that drives the bit. Rotating the drill string changes the orientation of the bent segment (e.g., the direction of the well being drilled and/or the "toolface"). Toolface control may be automated. Automated toolface controls require sensing of the downhole toolface as a feedback measurement for the control loop. Such feedback may be received as measurement-while-drilling (MWD) measurements, such as from MWD magnetic toolface measurements, and MWD gravity toolface measurements. Such measurements are transmitted to a surface control system from downhole using telemetries such as mud pulse telemetry and/or electromagnetic (EM) telemetry.

Such toolface measurements require 10-30 seconds to reach the surface and thus are transmitted at speeds that are suboptimal for automated toolface controls. Current techniques attempt to work around such sampling rate issues by predicting toolface measurements based on changes in differential pressure. Accordingly, a relationship between differential pressure and downhole MWD measurements is constructed so that MWD measurements may be predicted based on differential pressure measurements instead. For third party MWD tools, however, construction of such a relationship is dependent on the expertise of the driller. As such, an inexperienced driller may construct a flawed relationship that may not accurately determine MWD measurements from differential pressure measurements and such a flawed relationship may be used for the duration of the operation of the tool without correction. This can lead to inefficiencies, mistakes, and delays in the drilling process.

SUMMARY OF THE DISCLOSURE

In a first aspect, the disclosure relates to an apparatus for using a quill to steer a hydraulic motor when elongating a wellbore in a direction having a horizontal component. The apparatus may include a drilling tool comprising at least one measurement while drilling (MWD) instrument and a controller communicatively connected to the drilling tool. The controller may be configured to determine a first MWD estimation responsive to a drilling dynamic model associated with the drilling tool, wherein the first MWD estimation is associated with a first timeframe, receive first MWD data from the MWD instrument, wherein the first MWD data is associated with the first timeframe, compare the first MWD estimation and the first MWD data, determine a first error factor responsive to the comparison of the first MWD estimation and the first MWD data, determine a first updated drilling dynamic model responsive to the first error factor, determine a second MWD estimation responsive to the first updated drilling dynamic model, wherein the second MWD estimation is associated with a second timeframe, and provide, to the drilling tool, an output related to at least one operational parameter of the drilling tool.

In another aspect, the disclosure relates to a method for using a quill to steer a hydraulic motor when elongating a wellbore in a direction having a horizontal component. The method may include determining a first predicted measurement while drilling (MWD) estimation responsive to a drilling dynamic model associated with a drilling tool, wherein the first MWD estimation is associated with a first timeframe, receiving first MWD data from the drilling tool, wherein the first MWD data is associated with the first timeframe, comparing the first MWD estimation and the first MWD data, determining a first error factor responsive to the comparison of the first MWD estimation and the first MWD data, determining a first updated drilling dynamic model responsive to the first error factor, determining a second MWD estimation responsive to the first updated drilling dynamic model, wherein the second MWD estimation is associated with a second timeframe, and providing, to the drilling tool, an output related to at least one operational parameter of the drilling tool, wherein the output comprises instructions to adjust the at least one operational parameter of the drilling tool responsive to the second MWD estimation.

BRIEF DESCRIPTION OF THE DRAWINGS

The present disclosure is best understood from the following detailed description when read with the accompanying figures. It is emphasized that, in accordance with the standard practice in the industry, various features are not drawn to scale. In fact, the dimensions of the various features may be arbitrarily increased or reduced for clarity of discussion.

DETAILED DESCRIPTION OF EXEMPLARY EMBODIMENTS

Figure 1:
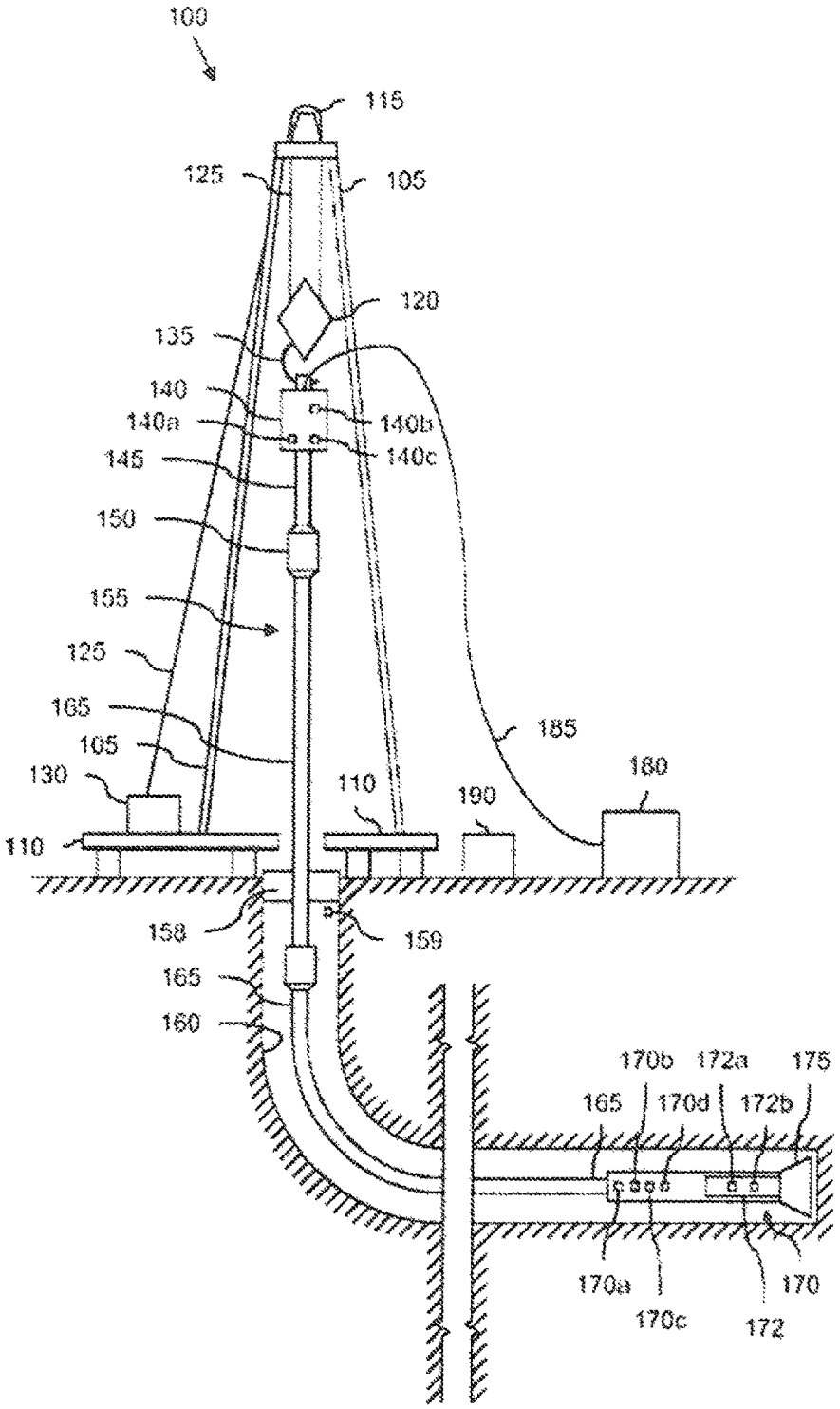
FIG. 1 is a schematic diagram of apparatus according to one or more aspects of the present disclosure.

Referring to FIG. 1, illustrated is a schematic view of apparatus 100 demonstrating one or more aspects of the present disclosure. The apparatus 100 is or includes a land-based drilling rig. However, one or more aspects of the present disclosure are applicable or readily adaptable to any type of drilling rig, such as jack-up rigs, semisubmersibles, drill ships, coil tubing rigs, well service rigs adapted for drilling and/or re-entry operations, and casing drilling rigs, among others within the scope of the present disclosure.

Apparatus 100 includes a mast 105 supporting lifting gear above a rig floor 110. The lifting gear includes a crown block 115 and a traveling block 120. The crown block 115 is coupled at or near the top of the mast 105, and the traveling block 120 hangs from the crown block 115 by a drilling line 125. The drilling line 125 extends from the lifting gear to drawworks 130, which is configured to reel out and reel in the drilling line 125 to cause the traveling block 120 to be lowered and raised relative to the rig floor 110.

A hook 135 is attached to the bottom of the traveling block 120. A top drive 140 is suspended from the hook 135. A quill 145 extending from the top drive 140 is attached to a saver sub 150, which is attached to a drill string 155 suspended within a wellbore 160. Alternatively, the quill 145 may be attached to the drill string 155 directly.

The term "quill" as used herein is not limited to a component which directly extends from the top drive, or which is otherwise conventionally referred to as a quill. For example, within the scope of the present disclosure, the "quill" may additionally or alternatively include a main shaft, a drive shaft, an output shaft, and/or another component which transfers torque, position, and/or rotation from the top drive or other rotary driving element to the drill string, at least indirectly. Nonetheless, albeit merely for the sake of clarity and conciseness, these components may be collectively referred to herein as the "quill."

The drill string 155 includes interconnected sections of drill pipe 165, a bottom hole assembly (BHA) 170, and a drill bit 175. The bottom hole assembly 170 may include stabilizers, drill collars, and/or measurement-while-drilling (MWD) or wireline conveyed instruments, among other components. The drill bit 175, which may also be referred to herein as a tool, is connected to the bottom of the BHA 170 or is otherwise attached to the drill string 155. One or more pumps 180 may deliver drilling fluid to the drill string 155 through a hose or other conduit 185, which may be connected to the top drive 140.

The downhole MWD or wireline conveyed instruments may be configured for the evaluation of physical properties such as pressure, temperature, torque, weight-on-bit (WOB), vibration, inclination, azimuth, toolface orientation in three-dimensional space, and/or other downhole parameters. These measurements may be made downhole, stored in solid-state memory for some time, and downloaded from the instrument(s) at the surface and/or transmitted to the surface. Data transmission methods may include, for example, digitally encoding data and transmitting the encoded data to the surface, possibly as pressure pulses in the drilling fluid or mud system, acoustic transmission through the drill string 155, electronically transmitted through a wireline or wired pipe, and/or transmitted as electromagnetic pulses. MWD tools and/or other portions of the BHA 170 may have the ability to store measurements for later retrieval via wireline and/or when the BHA 170 is tripped out of the wellbore 160.

In an exemplary embodiment, the apparatus 100 may also include a rotating blow-out preventer (BOP) 158, such as if the well 160 is being drilled utilizing under-balanced or managed-pressure drilling methods. In such embodiment, the annulus mud and cuttings may be pressurized at the surface, with the actual desired flow and pressure possibly being controlled by a choke system, and the fluid and pressure being retained at the well head and directed down the flow line to the choke by the rotating BOP 158. The apparatus 100 may also include a surface casing annular pressure sensor 159 configured to detect the pressure in the annulus defined between, for example, the wellbore 160 (or casing therein) and the drill string 155.

In the exemplary embodiment depicted in FIG. 1, the top drive 140 is utilized to impart rotary motion to the drill string 155. However, aspects of the present disclosure are also applicable or readily adaptable to implementations utilizing other drive systems, such as a power swivel, a rotary table, a coiled tubing unit, a downhole motor, and/or a conventional rotary rig, among others.

The apparatus 100 also includes a controller 190 configured to control or assist in the control of one or more components of the apparatus 100. For example, the controller 190 may be configured to transmit operational control signals to the drawworks 130, the top drive 140, the BHA 170 and/or the pump 180. The controller 190 may be a stand-alone component installed near the mast 105 and/or other components of the apparatus 100. In an exemplary embodiment, the controller 190 includes one or more systems located in a control room proximate the apparatus 100, such as the general purpose shelter often referred to as the "doghouse" serving as a combination tool shed, office, communications center and general meeting place. The controller 190 may be configured to transmit the operational control signals to the drawworks 130, the top drive 140, the BHA 170 and/or the pump 180 via wired or wireless transmission means which, for the sake of clarity, are not depicted in FIG. 1.

The controller 190 is also configured to receive electronic signals via wired or wireless transmission means (also not shown in FIG. 1) from a variety of sensors and/or MWD tools included in the apparatus 100, where each sensor is configured to detect an operational characteristic or parameter. One such sensor is the surface casing annular pressure sensor 159 described above. The apparatus 100 may include a downhole annular pressure sensor **170*a* coupled to or otherwise associated with the BHA 170. The downhole annular pressure sensor 170*a* may be configured to detect a pressure value or range in the annulus-shaped region defined between the external surface of the BHA 170 and the internal diameter of the wellbore 160**, which may also be referred to as the casing pressure, downhole casing pressure, MWD casing pressure, or downhole annular pressure.

It is noted that the meaning of the word "detecting," in the context of the present disclosure, may include detecting, sensing, measuring, calculating, and/or otherwise obtaining data. Similarly, the meaning of the word "detect" in the context of the present disclosure may include detect, sense, measure, calculate, and/or otherwise obtain data.

The apparatus 100 may additionally or alternatively include a shock/vibration sensor **170*b* that is configured for detecting shock and/or vibration in the BHA 170. The apparatus 100 may additionally or alternatively include a mud motor delta pressure ($\Delta P$) sensor 172*a* that is configured to detect a pressure differential value or range across one or more motors 172 of the BHA 170. The one or more motors 172 may each be or include a positive displacement drilling motor that uses hydraulic power of the drilling fluid to drive the bit 175, also known as a mud motor. One or more torque sensors 172*b* may also be included in the BHA 170 for sending data to the controller 190 that is indicative of the torque applied to the bit 175 by the one or more motors 172**.

The apparatus 100 may additionally or alternatively include a toolface sensor 170*c* configured to detect the current toolface orientation. The toolface sensor 170*c* may be or include a conventional or future-developed "magnetic toolface" which detects toolface orientation relative to magnetic north or true north. Alternatively, or additionally, the toolface sensor 170*c* may be or include a conventional or future-developed "gravity toolface" which detects toolface orientation relative to the Earth's gravitational field. The toolface sensor 170*c* may also, or alternatively, be or include a conventional or future-developed gyro sensor. The apparatus 100 may additionally or alternatively include a WOB sensor 170*d* integral to the BHA 170 and configured to detect WOB at or near the BHA 170.

The apparatus 100 may additionally or alternatively include a torque sensor 140*a* coupled to or otherwise associated with the top drive 140. The torque sensor 140*a* may alternatively be located in or associated with the BHA 170. The torque sensor 140*a* may be configured to detect a value or range of the torsion of the quill 145 and/or the drill string 155 (e.g., in response to operational forces acting on the drill string). The top drive 140 may additionally or alternatively include or otherwise be associated with a speed sensor 140*b* configured to detect a value or range of the rotational speed of the quill 145.

The top drive 140, draw works 130, crown or traveling block 120, drilling line or dead line anchor may additionally or alternatively include or otherwise be associated with a WOB sensor 140*c* (e.g., one or more sensors installed somewhere in the load path mechanisms to detect WOB, which can vary from rig-to-rig) different from the WOB sensor 170*d*. The WOB sensor 140*c* may be configured to detect a WOB value or range, where such detection may be performed at the top drive 140, draw works 130, or other component of the apparatus 100.

The detection performed by the sensors described herein may be performed once, continuously, periodically, and/or at random intervals. The detection may be manually triggered by an operator or other person accessing a human-machine interface (HMI), or automatically triggered by, for example, a triggering characteristic or parameter satisfying a predetermined condition (e.g., expiration of a time period, drilling progress reaching a predetermined depth, drill bit usage reaching a predetermined amount, etc.). Such sensors and/or other detection means may include one or more interfaces which may be local at the well/rig site or located at another, remote location with a network link to the system.

Figure 2:
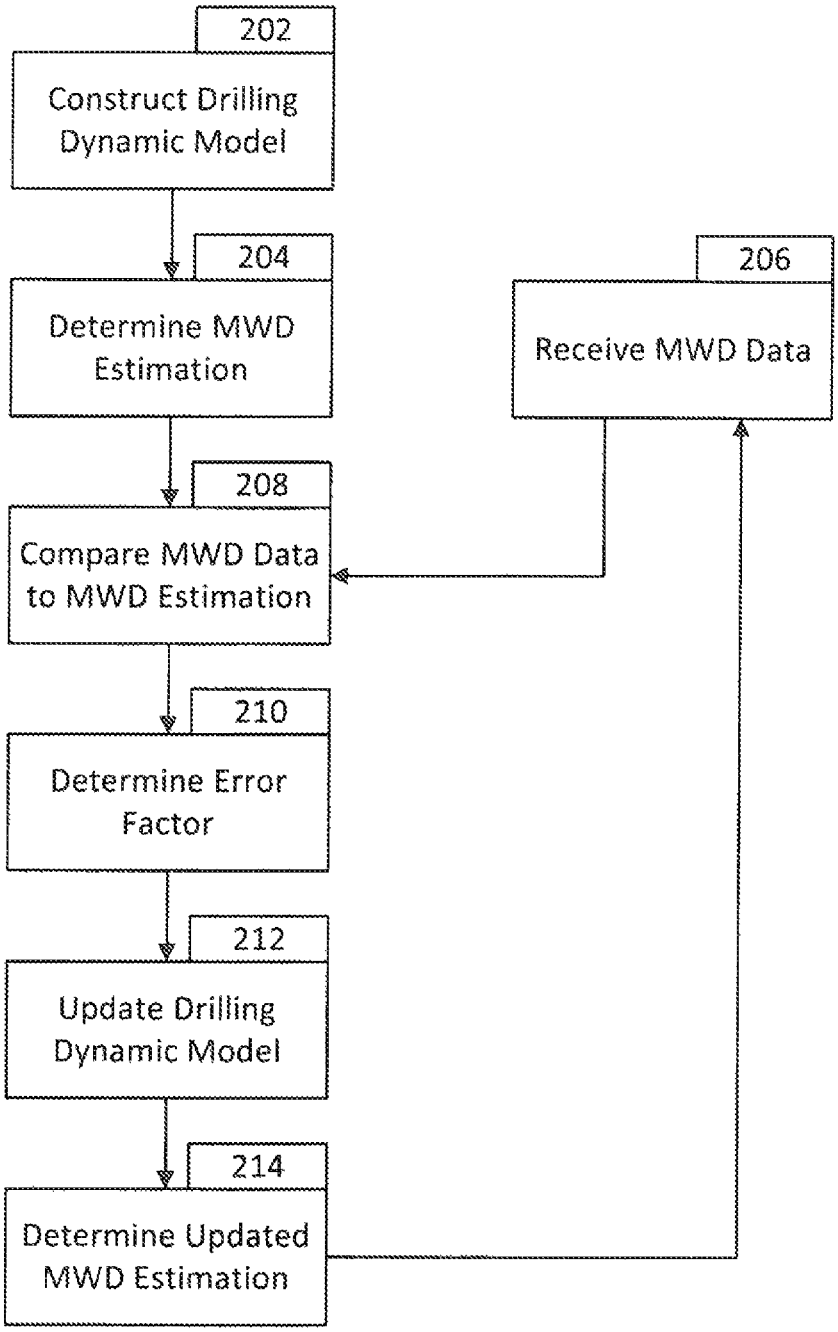
FIG. 2 is a flow-chart diagram of a method according to one or more aspects of the present disclosure.

Referring to FIG. 2, illustrated is a flow-chart diagram of a method according to one or more aspects of the present disclosure. The method may be performed in association with one or more components of the apparatus 100 shown in FIG. 1 during operation of the apparatus 100. For example, the method may be performed for controlling and/or adjusting operation of the apparatus 100 during drilling operations.

The method illustrated in FIG. 2 may be used to overcome certain limitations of MWD tools. For example, in order to maintain good control response, data from a controlled variable (e.g., an operating parameter of the apparatus 100 that is controlled by the operator and/or the controller 190) may need to be sampled at least 10 times faster than the fastest dynamic of the variable. For example, if the drill string 155 is able to rotate at 60 rpm (1 Hertz) and the position of the toolface is to be controlled (and the drill string 155 forms a part of and/or controls the toolface), the sampling frequency for data associated with the drill string 155 and/or the toolface orientation may need to be as much as ten times faster, which in this exemplary embodiment is at a sampling rate of 10 Hertz or every 100 milliseconds.

The method illustrated in FIG. 2 includes a step 202. In step 202, a state-space model of one or more components of the apparatus 100 is constructed. The state-space model may model dynamics of the quill 145, the saver sub 150, the drill string 155, the drill pipe 165, the bottom hole assembly 170, the drill bit 175, and/or any other component of the apparatus 100.

The state-space model may be a model of, for example, the torsional dynamics of the drill string 155 and/or a dynamic model that may include the stiffness characteristics, inertia characteristics, drag resistance, and/or other factors of components of the apparatus 100, drilling fluid and other items used during the operation of the apparatus 100, and/or the environment around the apparatus 100. For example, certain models may include characteristics associated with the operational characteristics of the top drive 140 (e.g., how quickly the top drive 140 is able to accelerate and/or decelerate the quill 145), with the fluid characteristics of the drilling fluid used, with the inertial and stiffness characteristics (e.g., torsional stiffness) of the drill string 155, the drill pipe 165, the bottom hole assembly 170, the drill bit 175 (including, in certain examples, the mud motor), and/or other components of the apparatus 100, the physics (e.g., hardness and rigidity) of the area being drilled, and/or other characteristics associated with the apparatus 100 and/or drilling operations using the apparatus 100.

In certain examples, the dynamic model may, for example, be a model that may receive one or more inputs and produce one or more outputs (e.g., a MWD estimation of step 204). Such inputs may be, for example, the torque and/or drilling speed outputted by the top drive 140, the amount and/or flow rate of the drilling fluid used, a configuration of the drill string 155, the drill pipe 165, the bottom hole assembly 170, the drill bit 175, and/or other components (e.g., for configurations of the apparatus 100 that may use different types of drill strings, drill pipes, bottom hole assemblies, and/or drill bits), and/or other such inputs. The outputs may include properties of the bottom hole assembly 170 and/or the drill bit 175 such as pressure, temperature, torque, weight-on-bit (WOB), vibration, inclination, azimuth, toolface orientation in three-dimensional space, and/or other downhole parameters, as well as possibly other properties associated with the operation of the apparatus 100.

In step 204, a MWD estimation may be derived and/or determined. The MWD estimation may be derived and/or determined according to, for example, the dynamic model constructed in step 202. As such, the dynamic model may receive inputs such as the inputs described in step 202 and provide outputs. In certain examples, one, some, or all of such inputs may be provided manually (e.g., entered into the controller 190 by an operator) while other examples may provide one, some, or all of such inputs automatically (e.g., a configuration of the apparatus 100 and/or operating characteristics such as the torque and/or drilling speed outputted by the top drive 140 may be determined by the controller 190).

The MWD estimation may be an output from the dynamic model. The MWD estimation may be an output related to one or more components of the apparatus 100 (e.g., the drill string 155, the drill pipe 165, the bottom hole assembly 170, the drill bit 175, and/or other components) such as pressure, temperature, torque, weight-on-bit (WOB), vibration, inclination, azimuth, toolface orientation in three-dimensional space, and/or other downhole parameters, as well as possibly other properties associated with the operation of the apparatus 100. As such, in step 204, the dynamic model may receive the inputs and provide one or more outputs responsive to the inputs received. In certain situations, such as when the apparatus 100 is just starting operations, certain inputs may be default inputs (e.g., a default value for ground hardness may be entered).

In certain examples, a linear-quadratic-Gaussian (LQG) algorithm may be used in determining the MWD estimation and control. Such an algorithm uses a Kalman filter and adjusts the gain of the Kalman filter to provide an updated MWD estimation responsive to MWD data received.

Such MWD data may be received in step 206 from, for example, MWD or driveline conveyed instruments and/or other such sensors. Examples of such sensors include sensors 170*a-d* and 172*a* and 172*b*. The MWD data may be data related to the output determined by the MWD estimation. For example, the MWD estimation may estimate a drilling angle associated with the toolface and the MWD data may be data that may indicate the drilling angle associated with the toolface.

The MWD data received in step 206 may be received at a period later than when the MWD estimation is derived and/or determined in step 204. In certain examples, such delay may be at least partially due to the transmission time of the MWD data. However, both the MWD estimation and the MWD data may at least partially be associated with a first timeframe (e.g., the MWD data may be data from such a first timeframe and the MWD estimation may be an estimate of what such MWD data from the first timeframe would indicate based on inputs received during the first timeframe) and allow for comparison between the MWD estimation and the MWD data. Such timeframes may cover at least one sampling period of MWD data. Thus, if MWD data is received only once every 10 or more seconds, the timeframes may cover at least one such 10 or more second period.

In step 208, the MWD data and the MWD estimation are compared. Such comparisons may include, for example, determining a difference between the MWD estimation and the MWD data. An error factor may be determined in step 210. The error factor may be determined at least partially from the comparison of the MWD data and the MWD estimation of step 208. The error factor determined in step 210 may be used to update the model constructed in step 212. The updated model may then be used to derive and/or determine an updated MWD estimation in step 214. The updated MWD estimation may be at least partially associated with a second timeframe. At least a portion of the second timeframe may be different from the first timeframe. In certain examples, the second timeframe may be subsequent to the first timeframe. In certain examples, sensed forces, torques, and other inputs may be applied to the updated drilling dynamic model to determine the updated MWD estimation. Such inputs may include conditions detected during operation of the apparatus 100 such as, for example, the torque and/or drilling speed outputted by the top drive 140, the amount and/or flow rate of the drilling fluid used, a configuration of the drill string 155, the drill pipe 165, the bottom hole assembly 170, the drill bit 175, and/or other components (e.g., for configurations of the apparatus 100 that may use different types of drill strings, drill pipes, bottom hole assemblies, and/or drill bits), and/or other such inputs.

In certain examples, a Kalman filter may be used. The Kalman filter may include one or more inputs and at least some of those one or more inputs may be used to determine an output associated with the MWD estimation and/or the MWD data. In an illustrative example, MWD data received may indicate toolface orientation. The MWD estimation may receive inputs related to dynamic characteristics of the top drive 140, the drill string 155, the drill bit 175, and/or other components of the apparatus 100 and output an estimated toolface orientation. Additionally, the Kalman filter may also include a filter gain that is a relative weight applied to each input. The relative weights may be the same or different. The relative weights may be determined in part or in whole based on the error factor 210 as discussed below. The filter gain may be indicative of the effect the input has to affect the output (e.g., whether changes in the input are more or less related to and/or correlated with changes in the output), of the uncertainty of the input (e.g., due to noise), and/or of other factors that may affect determination of the output.

Thus, in the example, in step 202, a dynamic model of the apparatus 100 may be constructed. The dynamic model may be constructed before and/or during operation of the apparatus 100. The dynamic model may, for example, estimate a toolface orientation and/or other operating factor of the apparatus 100. An MWD estimation of the toolface orientation is then determined from the inputs in step 204. In certain examples, such inputs may include conditions detected during operation of the apparatus 100 (e.g., drive torque). MWD data related to the toolface orientation is then received in step 206. The MWD estimation and the MWD data is compared in step 208. The comparison results in a determination of the error factor in step 210. The error factor determined in step 210 may then result in an adjustment of the filter gain for one or more of the inputs. The filter gain may adjust the relative weight of each input used in determining the MWD estimation and/or may adjust the model in another manner in step 212. A new MWD estimation may then be determined in step 214 from the updated model. The new MWD estimation may be determined using the updated filter gain. Additionally, in certain examples, the new MWD estimation may also include one or more new or changed inputs (e.g., if a characteristic of the top drive 140 such as the torque applied has been changed, an input related to the torque applied by the top drive 140 may be changed in determining the new MWD estimation).

In certain examples, the time delay of the transmission of MWD data to the controller 190 (e.g., the latency) may be unknown. Such a situation may occur when, for example, the time delay of the transmission of MWD data is changing, such as during drilling operations. In certain such situations, the precise drilling depth and, accordingly, the time delay due to the distance involved in the transmission of data, may be unknown. As such, the delay may also be a part of or another MWD estimation. In certain such examples, the time delay estimate may modify the filter gain or appropriately weight one or more inputs.

After the determination of the updated MWD estimation in step 214, the method may return to step 206 and additional MWD data may be received. The additional MWD data may also be associated with the second timeframe and may accordingly also be compared with the updated MWD data to determine further updated MWD estimations. Such a process may thus be performed recursively. However, in certain examples, one or more timeframes may not include updated MWD estimations (e.g., if only minimal error is determined in step 210 and/or if other operational conditions indicate that it is advantageous to not update the MWD estimation, or otherwise maintain the existing filter gain, such as if current conditions have not substantially changed in a manner from the last received MWD data sampling period).

Additionally, in certain situations in a timeframe subsequent to the first or second timeframe (e.g., a third timeframe), the additional MWD data may not be received or may stop being received in step 206. In such a situation, the current model may not be updated, but may still be used to determine a MWD estimation for the subsequent timeframe (e.g., determined using sensed forces, torques, and other inputs applied to the current model).

Figure 3:
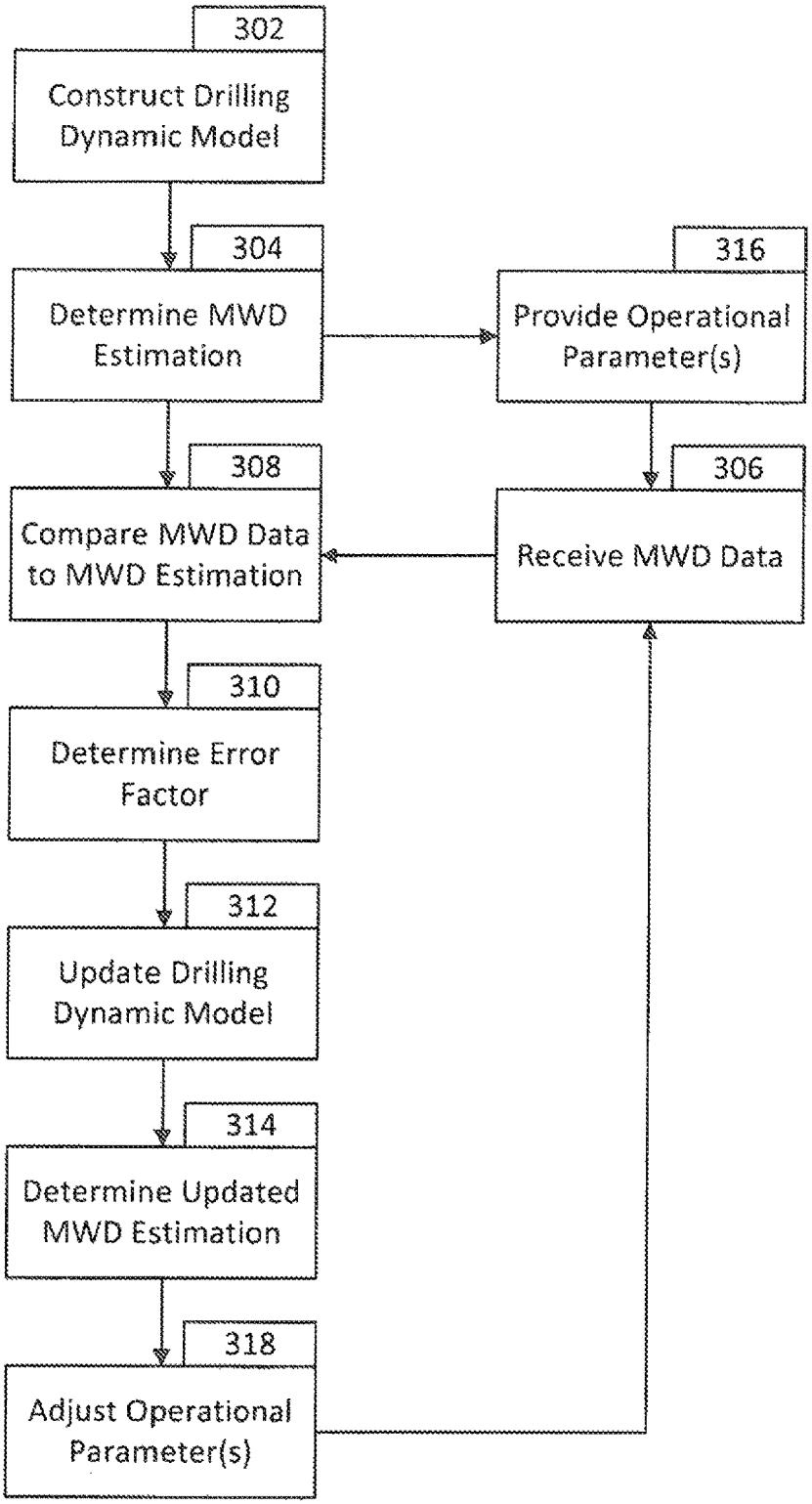
FIG. 3 is a flow-chart diagram of a method according to one or more aspects of the present disclosure.

Referring to FIG. 3, illustrated is a flow-chart diagram of another embodiment of the method shown in FIG. 2. Steps 302, 304, 306, 308, 310, 312, and 314 of FIG. 3 may be similar to the respective steps 202, 204, 206, 208, 210, 212, and 214 of FIG. 2.

Additionally, in FIG. 3, after the determination of the MWD estimation in step 304, one or more operational parameters may be provided in step 316. The one or more operational parameters may include instructions related to operation of the apparatus 100, including instructions related to an operational parameter of one or more components of the apparatus 100 such as a drilling fluid flow rate, a drive torque, a rotational speed, a WOB, and/or a drilling angle. Such operational parameters may, for example, be used to control and/or change a toolface orientation and/or drilling path.

Also, in FIG. 3, in step 318, after the determination of the updated MWD estimation in step 314, one or more operational parameters may be adjusted responsive to the updated MWD estimation. Adjustment of the operational parameter in step 318 may be made to correct or maintain an orientation, drilling path, and/or speed of the apparatus 100. After step 318, the process may then return to step 306 and receive additional MWD data. The process may thus be performed recursively.

In situations where, in a timeframe subsequent to the first or second timeframe (e.g., a third timeframe), the additional MWD data is no longer being received and the current model is not being updated, a MWD estimation for the subsequent timeframe may still be determined (e.g., determined using sensed forces and torques applied to the current model). The MWD estimation may then be used to generate an output related to at least one operational parameter and may lead to adjustment of the at least one operational parameter.

Each of the steps of the methods described in FIGS. 2 and 3 may be performed automatically. For example, the controller 190 of FIG. 1 may be configured to automatically adjust the one or more operational parameters in step 218 or 318. These can be set to adjust based on inputs, pre-set conditions, or conditions adjusted by a driller during the operation of the apparatus. As such, a well bore may be more accurately and/or quickly drilled, wear and tear of the drill bit 175 and/or other component of the apparatus 100 may be reduced, and/or the toolface orientation may be adjusted at a quicker rate than what is possible when relying on only MWD data received. Additionally, the methods described in FIGS. 2 and 3 may allow for frequent and/or quick correction of any flaws in the dynamic model. As such, any potential damage or operational delays from the such flaws may be minimized.

Figure 4:
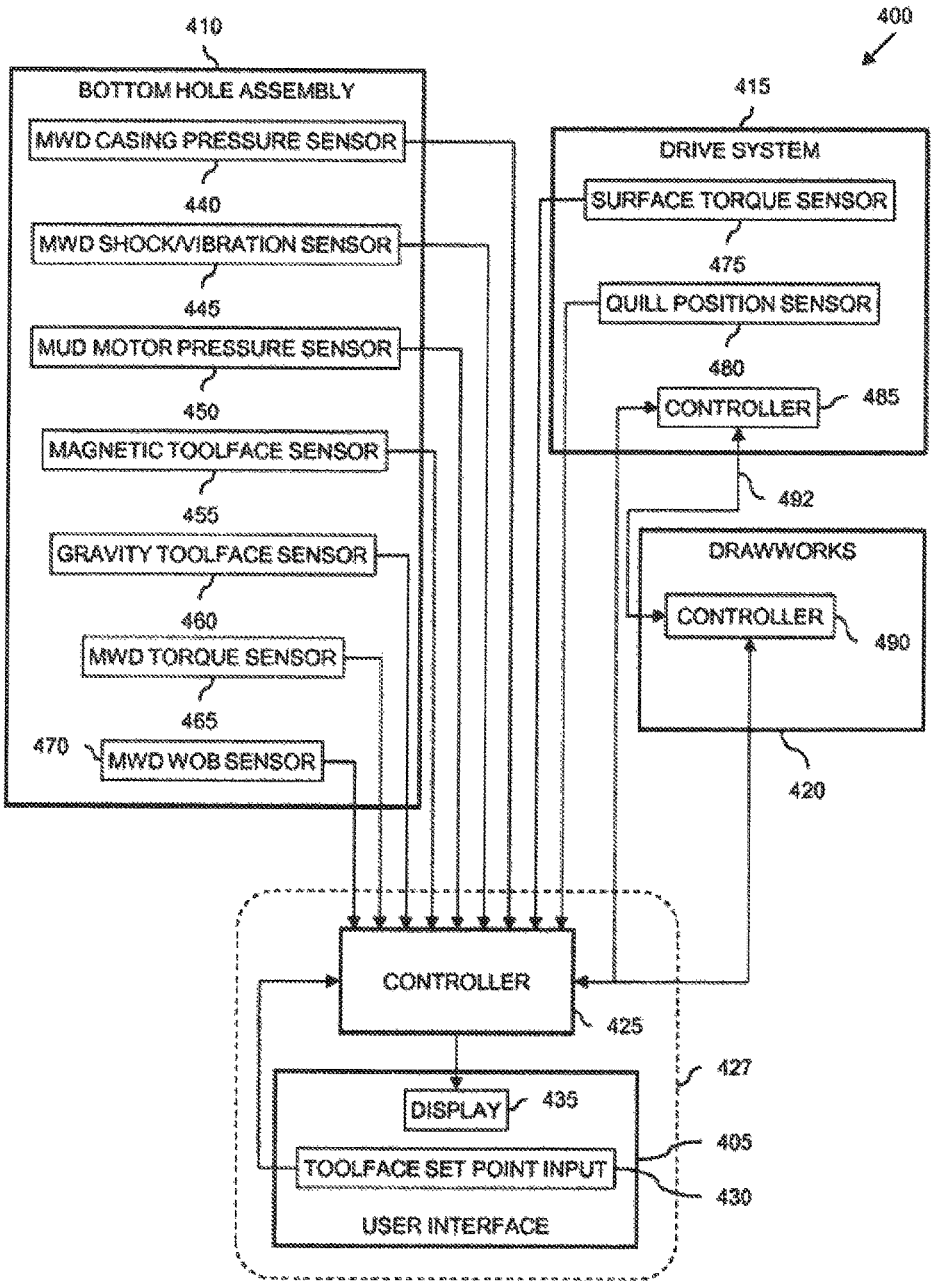
FIG. 4 is a schematic diagram of apparatus according to one or more aspects of the present disclosure.

Referring to FIG. 4, illustrated is a block diagram of an apparatus 400 according to one or more aspects of the present disclosure. The apparatus 400 includes a user interface 405, a BHA 410, a drive system 415, a drawworks 420 and a controller 425. The apparatus 400 may be implemented within the environment and/or apparatus shown in FIG. 1. For example, the BHA 410 may be substantially similar to the BHA 170 shown in FIG. 1, the drive system 415 may be substantially similar to the top drive 140 shown in FIG. 1, the drawworks 420 may be substantially similar to the drawworks 130 shown in FIG. 1, and/or the controller 425 may be substantially similar to the controller 190 shown in FIG. 1. The apparatus 400 may also be utilized in performing the method described in FIG. 2 and/or the method described in FIG. 3.

The user-interface 405 and the controller 425 may be discrete components that are interconnected via wired or wireless means. Alternatively, the user-interface 405 and the controller 425 may be integral components of a single system 427, as indicated by the dashed lines in FIG. 4.

The user-interface 405 includes means 430 for user-input of one or more toolface set points, and may also include means for user-input of other set points, limits, and other input data. The data input means 430 may include a keypad, voice-recognition apparatus, dial, joystick, mouse, data base and/or other conventional or future-developed data input device. Such data input means may support data input from local and/or remote locations. Alternatively, or additionally, the data input means 430 may include means for user-selection of predetermined toolface set point values or ranges, such as via one or more drop-down menus. The toolface set point data may also or alternatively be selected by the controller 425 via the execution of one or more database look-up procedures. In general, the data input means and/or other components within the scope of the present disclosure support operation and/or monitoring from stations on the rig site as well as one or more remote locations with a communications link to the system, network, local area network (LAN), wide area network (WAN), Internet, satellite-link, and/or radio, among other means.

The user-interface 405 may also include a display 435 for visually presenting information to the user in textual, graphical or video form. In certain examples, the MWD estimations and/or MWD data may be communicated via the display 435 and/or another portion of the user-interface 405. The display 435 may also be utilized by the user to input the toolface set point data in conjunction with the data input means 430. For example, the toolface set point data input means 430 may be integral to or otherwise communicably coupled with the display 435.

The BHA 410 may include an MWD casing pressure sensor 440 that is configured to detect an annular pressure value or range at or near the MWD portion of the BHA 410, and that may be substantially similar to the pressure sensor 170*a* shown in FIG. 1. The casing pressure data detected via the MWD casing pressure sensor 440 may be sent via electronic signal to the controller 425 via wired or wireless transmission.

The BHA 410 may also include an MWD shock/vibration sensor 445 that is configured to detect shock and/or vibration in the MWD portion of the BHA 410, and that may be substantially similar to the shock/vibration sensor 170*b* shown in FIG. 1. The shock/vibration data detected via the MWD shock/vibration sensor 445 may be sent via electronic signal to the controller 425 via wired or wireless transmission.

The BHA 410 may also include a mud motor ΔP sensor 450 that is configured to detect a pressure differential value or range across the mud motor of the BHA 410, and that may be substantially similar to the mud motor ΔP sensor 172*a* shown in FIG. 1. The pressure differential data detected via the mud motor ΔP sensor 450 may be sent via electronic signal to the controller 425 via wired or wireless transmission. The mud motor ΔP may be alternatively or additionally calculated, detected, or otherwise determined at the surface, such as by calculating the difference between the surface standpipe pressure just off-bottom and pressure once the bit touches bottom and starts drilling and experiencing torque.

The BHA 410 may also include a magnetic toolface sensor 455 and a gravity toolface sensor 460 that are cooperatively configured to detect the current toolface, and that collectively may be substantially similar to the toolface sensor 170*c* shown in FIG. 1. The magnetic toolface sensor 455 may be or include a conventional or future-developed "magnetic toolface" which detects toolface orientation relative to magnetic north or true north. The gravity toolface sensor 460 may be or include a conventional or future-developed "gravity toolface" which detects toolface orientation relative to the Earth's gravitational field. In an exemplary embodiment, the magnetic toolface sensor 455 may detect the current toolface when the end of the wellbore is less than about 7° from vertical, and the gravity toolface sensor 460 may detect the current toolface when the end of the wellbore is greater than about 7° from vertical. However, other toolface sensors may also be utilized within the scope of the present disclosure, including non-magnetic toolface sensors and non-gravitational inclination sensors. In any case, the toolface orientation detected via the one or more toolface sensors (e.g., sensors 455 and/or 460) may be sent via electronic signal to the controller 420 via wired or wireless transmission.

The BHA 410 may also include an MWD torque sensor 465 that is configured to detect a value or range of values for torque applied to the bit by the motor(s) of the BHA 410, and that may be substantially similar to the torque sensor 172*b* shown in FIG. 1. The torque data detected via the MWD torque sensor 465 may be sent via electronic signal to the controller 425 via wired or wireless transmission.

The BHA 410 may also include an MWD WOB sensor 470 that is configured to detect a value or range of values for WOB at or near the BHA 410, and that may be substantially similar to the WOB sensor 170*d* shown in FIG. 1. The WOB data detected via the MWD WOB sensor 470 may be sent via electronic signal to the controller 425 via wired or wireless transmission.

The drawworks 420 includes a controller 490 and/or other means for controlling feed out and/or feed-in of a drilling line (such as the drilling line 125 shown in FIG. 1). Such control may include directional control (in vs. out) as well as feed rate. However, exemplary embodiments within the scope of the present disclosure include those in which the drawworks drill string feed off system may alternatively be a hydraulic ram or rack and pinion type hoisting system rig, where the movement of the drill string up and down is via something other than a drawworks. The drill string may also take the form of coiled tubing, in which case the movement of the drill string in and out of the hole is controlled by an injector head which grips and pushes/pulls the tubing in/out of the hole. Nonetheless, such embodiments may still include a version of the controller 490, and the controller 490 may still be configured to control feed-out and/or feed-in of the drill string.

The drive system 415 includes a surface torque sensor 475 that is configured to detect a value or range of the reactive torsion of the quill or drill string, much the same as the torque sensor 140*a* shown in FIG. 1. The drive system 415 also includes a quill position sensor 480 that is configured to detect a value or range of the rotational position of the quill, such as relative to true north or another stationary reference. The surface torsion and quill position data detected via sensors 475 and 480, respectively, may be sent via electronic signal to the controller 425 via wired or wireless transmission. The drive system 415 also includes a controller 485 and/or other means for controlling the rotational position, speed and direction of the quill or other drill string component coupled to the drive system 415 (such as the quill 145 shown in FIG. 1).

In an exemplary embodiment, the drive system 415, controller 485, and/or other component of the apparatus 400 may include means for accounting for friction between the drill string and the wellbore. For example, such friction accounting means may be configured to detect the occurrence and/or severity of the friction, which may then be subtracted from the actual "reactive" torque, perhaps by the controller 485 and/or another control component of the apparatus 400. Additionally, a magnitude and/or severity of such friction may be detected and may be a component used in the MWD estimation.

The controller 425 is configured to receive one or more of the above-described parameters from the user interface 405, the BHA 410 and the drive system 415, and utilize the parameters to continuously, periodically, or otherwise determine the current toolface orientation. The controller 425 may be further configured to generate a control signal, such as via intelligent adaptive control, and provide the control signal to the drive system 415 and/or the drawworks 420 to adjust and/or maintain the toolface orientation. For example, the controller 425 may execute the method described in FIG. 3 to provide one or more signals to the drive system 415 and/or the drawworks 420 to increase or decrease WOB and/or quill position, such as may be required to accurately "steer" the drilling operation.

Moreover, as in the exemplary embodiment depicted in FIG. 4, the controller 485 of the drive system 415 and/or the controller 490 of the drawworks 420 may be configured to generate and transmit a signal to the controller 425. Consequently, the controller 485 of the drive system 415 may be configured to influence the control of the BHA 410 and/or the drawworks 420 to assist in obtaining and/or maintaining a desired toolface orientation. Similarly, the controller 490 of the drawworks 420 may be configured to influence the control of the BHA 410 and/or the drive system 415 to assist in obtaining and/or maintaining a desired toolface orientation. Alternatively, or additionally, the controller 485 of the drive system 415 and the controller 490 of the drawworks 420 may be configured to communicate directly, such as indicated by the dual-directional arrow 492 depicted in FIG. 4. Consequently, the controller 485 of the drive system 415 and the controller 490 of the drawworks 420 may be configured to cooperate in obtaining and/or maintaining a desired toolface orientation. Such cooperation may be independent of control provided to or from the controller 425 and/or the BHA 410.

Figure 5A:
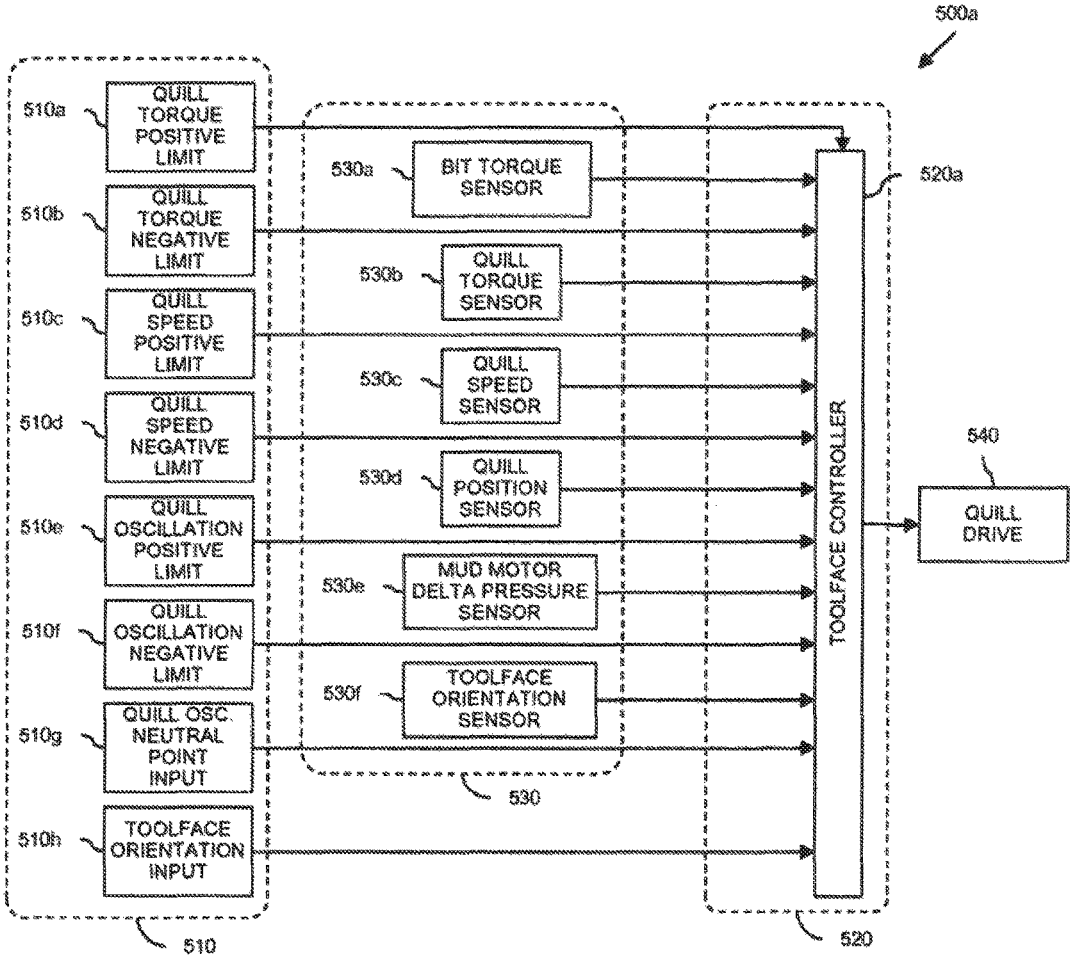
FIG. 5A is a schematic diagram of apparatus accordingly to one or more aspects of the present disclosure.

Referring to FIG. 5A, illustrated is a schematic view of at least a portion of an apparatus 500*a* according to one or more aspects of the present disclosure. The apparatus 500*a* is an exemplary implementation of the apparatus 100 shown in FIG. 1 and/or the apparatus 400 shown in FIG. 4, and is an exemplary environment in which the method described in FIG. 2 and/or the method described in FIG. 3 may be performed. The apparatus 500*a* includes a plurality of user inputs 510 and at least one processor 520. The user inputs 510 include a quill torque positive limit 510*a*, a quill torque negative limit 510*b*, a quill speed positive limit 510*c*, a quill speed negative limit 510*d*, a quill oscillation positive limit 510*e*, a quill oscillation negative limit 510*f*, a quill oscillation neutral point input 510*g*, and a toolface orientation input 510*h*. Other embodiments within the scope of the present disclosure, however, may utilize additional or alternative user inputs 510. The user inputs 510 may be substantially similar to the user input 430 or other components of the user interface 405 shown in FIG. 4. The at least one processor 520 may form at least a portion of, or be formed by at least a portion of, the controller 425 shown in FIG. 4 and/or the controller 485 of the drive system 415 shown in FIG. 4.

In the exemplary embodiment depicted in FIG. 5A, the at least one processor 520 includes a toolface controller 520*a*, and the apparatus 500*a* also includes or is otherwise associated with a plurality of sensors 530. The plurality of sensors 530 includes a bit torque sensor 530*a*, a quill torque sensor 530*b*, a quill speed sensor 530*c*, a quill position sensor 530*d*, a mud motor ΔP sensor 530*e* and a toolface orientation sensor 530*f*. Other embodiments within the scope of the present disclosure, however, may utilize additional or alternative sensors 530. In an exemplary embodiment, each of the plurality of sensors 530 may be located at the surface of the wellbore; that is, the sensors 530 are not located downhole proximate the bit, the bottom hole assembly, and/or any measurement-while-drilling tools. In other embodiments, however, one or more of the sensors 530 may not be surface sensors. For example, in an exemplary embodiment, the quill torque sensor 530*b*, the quill speed sensor 530*c*, and the quill position sensor 530*d* may be surface sensors, whereas the bit torque sensor 530*a*, the mud motor ΔP sensor 530*e*, and the toolface orientation sensor 530*f* may be downhole sensors (e.g., MWD sensors). Moreover, individual ones of the sensors 530 may be substantially similar to corresponding sensors shown in FIG. 1 or FIG. 4.

The apparatus 500*a* also includes or is associated with a quill drive 540. The quill drive 540 may form at least a portion of a top drive or another rotary drive system, such as the top drive 140 shown in FIG. 1 and/or the drive system 415 shown in FIG. 4. The quill drive 540 is configured to receive a quill drive control signal from the at least one processor 520, if not also form other components of the apparatus 500*a*. The quill drive control signal directs the position (e.g., azimuth), spin direction, spin rate, and/or oscillation of the quill. The toolface controller 520*a* is configured to generate the quill drive control signal, utilizing data received from the user inputs 510 and the sensors 530.

The toolface controller 520*a* may compare the actual torque of the quill to the quill torque positive limit received from the corresponding user input 510*a*. For the purposes of this disclosure, the actual torque of the quill may be determined utilizing data received from the quill torque sensor 530*b* and/or may be a MWD estimation of the torque of the quill determined from various inputs. As such, the actual torque of the quill may be a MWD estimation. For example, if the actual torque of the quill exceeds the quill torque positive limit, then the quill drive control signal may direct the quill drive 540 to reduce the torque being applied to the quill. In an exemplary embodiment, the toolface controller 520*a* may be configured to optimize drilling operation parameters related to the actual torque of the quill, such as by maximizing the actual torque of the quill without exceeding the quill torque positive limit.

The toolface controller 520*a* may alternatively or additionally compare the actual torque of the quill to the quill torque negative limit received from the corresponding user input 510*b*. For example, if the actual torque of the quill is less than the quill torque negative limit, then the quill drive control signal may direct the quill drive 540 to increase the torque being applied to the quill. In an exemplary embodiment, the toolface controller 520*a* may be configured to optimize drilling operation parameters related to the actual torque of the quill, such as by minimizing the actual torque of the quill while still exceeding the quill torque negative limit.

The toolface controller 520*a* may alternatively or additionally compare the actual speed of the quill to the quill speed positive limit received from the corresponding user input 510*c*. The actual speed of the quill may be determined utilizing data received from the quill speed sensor 530*c* and/or may be a MWD estimation of the speed of the quill determined from various inputs. For example, if the actual speed of the quill exceeds the quill speed positive limit, then the quill drive control signal may direct the quill drive 540 to reduce the speed at which the quill is being driven. In an exemplary embodiment, the toolface controller 520*a* may be configured to optimize drilling operation parameters related to the actual speed of the quill, such as by maximizing the actual speed of the quill without exceeding the quill speed positive limit.

The toolface controller 520*a* may alternatively or additionally compare the actual speed of the quill to the quill speed negative limit received from the corresponding user input 510*d*. For example, if the actual speed of the quill is less than the quill speed negative limit, then the quill drive control signal may direct the quill drive 540 to increase the speed at which the quill is being driven. In an exemplary embodiment, the toolface controller 520*a* may be configured to optimize drilling operation parameters related to the actual speed of the quill, such as by minimizing the actual speed of the quill while still exceeding the quill speed negative limit.

The toolface controller 520*a* may alternatively or additionally compare the actual orientation (azimuth) of the quill to the quill oscillation positive limit received from the corresponding user input 510*e*. The actual orientation of the quill may be determined utilizing data received from the quill position sensor 530*d* and/or may be a MWD estimation of the orientation of the quill determined from various inputs. For example, if the actual orientation of the quill exceeds the quill oscillation positive limit, then the quill drive control signal may direct the quill drive 540 to rotate the quill to within the quill oscillation positive limit, or to modify quill oscillation parameters such that the actual quill oscillation in the positive direction (e.g., clockwise) does not exceed the quill oscillation positive limit. In an exemplary embodiment, the toolface controller 520*a* may be configured to optimize drilling operation parameters related to the actual oscillation of the quill, such as by maximizing the amount of actual oscillation of the quill in the positive direction without exceeding the quill oscillation positive limit.

The toolface controller 520*a* may alternatively or additionally compare the actual orientation of the quill to the quill oscillation negative limit received from the corresponding user input 510*f*. For example, if the actual orientation of the quill is less than the quill oscillation negative limit, then the quill drive control signal may direct the quill drive 540 to rotate the quill to within the quill oscillation negative limit, or to modify quill oscillation parameters such that the actual quill oscillation in the negative direction (e.g., counter-clockwise) does not exceed the quill oscillation negative limit. In an exemplary embodiment, the toolface controller 520*a* may be configured to optimize drilling operation parameters related to the actual oscillation of the quill, such as by maximizing the actual amount of oscillation of the quill in the negative direction without exceeding the quill oscillation negative limit.

The toolface controller 520*a* may alternatively or additionally compare the actual neutral point of quill oscillation to the desired quill oscillation neutral point input received from the corresponding user input 510*g*. The actual neutral point of the quill oscillation may be determined utilizing data received from the quill position sensor 530*d* and/or may be a MWD estimation of the neutral point of quill oscillation determined from various inputs. For example, if the actual quill oscillation neutral point varies from the desired quill oscillation neutral point by a predetermined amount, or falls outside a desired range of the oscillation neutral point, then the quill drive control signal may direct the quill drive 540 to modify quill oscillation parameters to make the appropriate correction.

The toolface controller 520*a* may alternatively or additionally compare the actual orientation of the toolface (the actual orientation of the toolface may, in certain examples, be a MWD estimation of the orientation of the toolface) to the toolface orientation input received from the corresponding user input 510*h*. The toolface orientation input received from the user input 510*h* may be a single value indicative of the desired toolface orientation. For example, if the actual toolface orientation differs from the toolface orientation input value by a predetermined amount, then the quill drive control signal may direct the quill drive 540 to rotate the quill an amount corresponding to the necessary correction of the toolface orientation. However, the toolface orientation input received from the user input 510*h* may alternatively be a range within which it is desired that the toolface orientation remain. For example, if the actual toolface orientation is outside the toolface orientation input range, then the quill drive control signal may direct the quill drive 540 to rotate the quill an amount necessary to restore the actual toolface orientation to within the toolface orientation input range. In an exemplary embodiment, the actual toolface orientation is compared to a toolface orientation input that is automated, perhaps based on a predetermined and/or constantly updating plan, possibly taking into account drilling progress path error.

In each of the above-mentioned comparisons and/or calculations performed by the toolface controller, the actual mud motor ΔP (pressure differential) and/or the actual bit torque may also be utilized in the generation of the quill drive signal. The actual mud motor ΔP may be determined utilizing data received from the mud motor ΔP sensor 530*e*, and/or by measurement of pump pressure before the bit is on bottom and tare of this value, and the actual bit torque may be determined utilizing data received from the bit torque sensor 530*a*. Alternatively, the actual bit torque may be calculated utilizing data received from the mud motor ΔP sensor 530*e*, because actual bit torque and actual mud motor ΔP are proportional.

One example in which the actual mud motor ΔP and/or the actual bit torque may be utilized is when the actual toolface orientation cannot be relied upon to provide accurate or fast enough data. For example, such may be the case during "blind" drilling, or other instances in which the driller is no longer receiving data from the toolface orientation sensor 530*f*. In such occasions, the actual bit torque and/or the actual mud motor ΔP can be utilized to determine the actual toolface orientation. Toolface orientation can also be estimated using drilling dynamic models and sensed forces and torques applied to (e.g., inputted into) such a drilling dynamic model. For example, if all other drilling parameters remain the same, a change in the actual bit torque and/or the actual mud motor ΔP can indicate a proportional rotation of the toolface orientation in the same or opposite direction of drilling. For example, an increasing torque or ΔP may indicate that the toolface is changing in the opposite direction of drilling, whereas a decreasing torque or ΔP may indicate that the toolface is moving in the same direction as drilling. Thus, in this manner, the data received from the bit torque sensor 530*a* and/or the mud motor ΔP sensor 530*e* can be utilized by the toolface controller 520 in the generation of the quill drive signal, such that the quill can be driven in a manner which corrects for or otherwise takes into account any bit rotation which is indicated by a change in the actual bit torque and/or actual mud motor ΔP.

Moreover, under some operating conditions, the data received by the toolface controller 520 from the toolface orientation sensor 530*f* can lag the actual toolface orientation. For example, the toolface orientation sensor 530*f* may only determine the actual toolface periodically, or a considerable time period may be required for the transmission of the data from the toolface to the surface. In fact, it is not uncommon for such delay to be 30 seconds or more. Consequently, in some implementations, it may be more accurate or otherwise advantageous for the toolface controller 520*a* to utilize the actual torque and pressure data received from the bit torque sensor 530*a* and the mud motor ΔP sensor 530*e* in addition to, if not in the alternative to, utilizing the actual toolface data received from the toolface orientation sensor 530*f*. Certain examples may utilize the actual torque and pressure data received from the bit torque sensor 530*a* and the mud motor ΔP sensor 530*e*, as well as possibly other sensors, as inputs in MWD estimation.

Figure 5B:
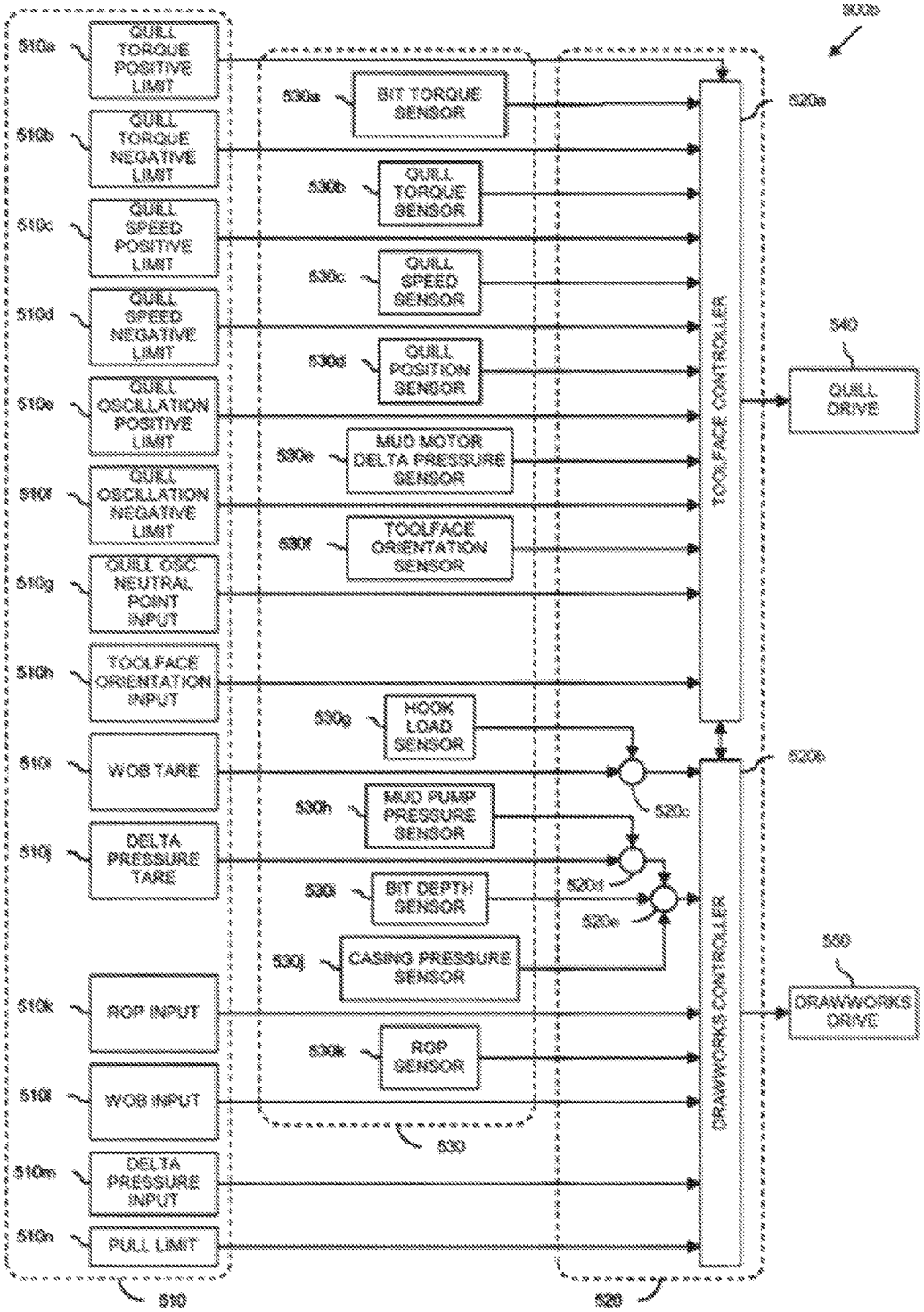
FIG. 5B is a schematic diagram of another embodiment of the apparatus shown in FIG. 5A.

Referring to FIG. 5B, illustrated is a schematic view of at least a portion of another embodiment of the apparatus 500*a*, herein designated by the reference numeral 500*b*. Like the apparatus 500*a*, the apparatus 500*b* is an exemplary implementation of the apparatus 100 shown in FIG. 1 and/or the apparatus 400 shown in FIG. 4, and is an exemplary environment in which the method described in FIG. 2 and/or the method described in FIG. 3 may be performed. The apparatus 500*b* includes the plurality of user inputs 510 and the at least one processor 520, like the apparatus 500*a*. For example, the user inputs 510 of the apparatus 500*b* include the quill torque positive limit 510*a*, the quill torque negative limit 510*b*, the quill speed positive limit 510*c*, the quill speed negative limit 510*d*, the quill oscillation positive limit 510*e*, the quill oscillation negative limit 510*f*, the quill oscillation neutral point input 510*g*, and the toolface orientation input 510*h*. However, the user inputs 510 of the apparatus 500*b* also include a WOB tare 510*i*, a mud motor ΔP tare 510*j*, an ROP input 510*k*, a WOB input 510*l*, a mud motor ΔP input 510*m* and a hook load limit 510*n*. Other embodiments within the scope of the present disclosure, however, may utilize additional or alternative user inputs 510.

In the exemplary embodiment depicted in FIG. 5B, the at least one processor 520 includes the toolface controller 520*a*, described above, and a drawworks controller 520*b*. The apparatus 500*b* also includes or is otherwise associated with a plurality of sensors 530, the quill drive 540 and a drawworks drive 550. The plurality of sensors 530 includes the bit torque sensor 530*a*, the quill torque sensor 530*b*, the quill speed sensor 530*c*, the quill position sensor 530*d*, the mud motor ΔP sensor 530*e* and the toolface orientation sensor 530*f*, like the apparatus 500*a*. However, the plurality of sensors 530 of the apparatus 500*b* also includes a hook load sensor 530*g*, a mud pump pressure sensor 530*h*, a bit depth sensor 530*i*, a casing pressure sensor 530*j* and an ROP sensor 530*k*. Other embodiments within the scope of the present disclosure, however, may utilize additional or alternative sensors 530. In the exemplary embodiment of the apparatus 500*b* shown in FIG. 5B, each of the plurality of sensors 530 may be located at the surface of the wellbore, downhole (e.g., MWD), or elsewhere.

As described above, the toolface controller 520*a* is configured to generate a quill drive control signal utilizing data received from ones of the user inputs 510 and the sensors 530, and subsequently provide the quill drive control signal to the quill drive 540, thereby controlling the toolface orientation by driving the quill orientation and speed. Thus, the quill drive control signal is configured to control (at least partially) the quill orientation (e.g., azimuth) as well as the speed and direction of rotation of the quill (if any).

The drawworks controller 520*b* is configured to generate a drawworks drum (or brake) drive control signal also utilizing data received from ones of the user inputs 510 and the sensors 530. Thereafter, the drawworks controller 520*b* provides the drawworks drive control signal to the drawworks drive 550, thereby controlling the feed direction and rate of the drawworks. The drawworks drive 550 may form at least a portion of, or may be formed by at least a portion of, the drawworks 130 shown in FIG. 1 and/or the drawworks 420 shown in FIG. 4. The scope of the present disclosure is also applicable or readily adaptable to other means for adjusting the vertical positioning of the drill string. For example, the drawworks controller 520*b* may be a hoist controller, and the drawworks drive 550 may be or include means for hoisting the drill string other than or in addition to a drawworks apparatus (e.g., a rack and pinion apparatus).

The apparatus 500*b* also includes a comparator 520*c* which compares current hook load data with the WOB tare to generate the current WOB. The current hook load data is received from the hook load sensor 530*g*, and the WOB tare is received from the corresponding user input 510*i*.

The drawworks controller 520*b* compares the current WOB with WOB input data. The current WOB is received from the comparator 520*c*, and the WOB input data is received from the corresponding user input 510*l*. The WOB input data received from the user input 510*l* may be a single value indicative of the desired WOB. For example, if the actual WOB differs from the WOB input by a predetermined amount, then the drawworks drive control signal may direct the drawworks drive 550 to feed cable in or out an amount corresponding to the necessary correction of the WOB. However, the WOB input data received from the user input 510*l* may alternatively be a range within which it is desired that the WOB be maintained. For example, if the actual WOB is outside the WOB input range, then the drawworks drive control signal may direct the drawworks drive 550 to feed cable in or out an amount necessary to restore the actual WOB to within the WOB input range. In an exemplary embodiment, the drawworks controller 520*b* may be configured to optimize drilling operation parameters related to the WOB, such as by maximizing the actual WOB without exceeding the WOB input value or range.

The apparatus 500*b* also includes a comparator 520*d* which compares mud pump pressure data with the mud motor ΔP tare to generate an "uncorrected" mud motor ΔP. The mud pump pressure data is received from the mud pump pressure sensor 530*h*, and the mud motor ΔP tare is received from the corresponding user input 510*j*.

The apparatus 500*b* also includes a comparator 520*e* which utilizes the uncorrected mud motor ΔP along with bit depth data and casing pressure data to generate a "corrected" or current mud motor ΔP. The bit depth data is received from the bit depth sensor 530*i*, and the casing pressure data is received from the casing pressure sensor 530*j*. The casing pressure sensor 530*j* may be a surface casing pressure sensor, such as the sensor 159 shown in FIG. 1, and/or a downhole casing pressure sensor, such as the sensor 170*a* shown in FIG. 1, and in either case may detect the pressure in the annulus defined between the casing or wellbore diameter and a component of the drill string.

The drawworks controller 520*b* compares the current mud motor ΔP with mud motor ΔP input data. The current mud motor ΔP is received from the comparator 520*e*, and the mud motor ΔP input data is received from the corresponding user input 510*m*. The mud motor ΔP input data received from the user input 510*m* may be a single value indicative of the desired mud motor ΔP. For example, if the current mud motor ΔP differs from the mud motor ΔP input by a predetermined amount, then the drawworks drive control signal may direct the drawworks drive 550 to feed cable in or out an amount corresponding to the necessary correction of the mud motor ΔP. However, the mud motor ΔP input data received from the user input 510*m* may alternatively be a range within which it is desired that the mud motor ΔP be maintained. For example, if the current mud motor ΔP is outside this range, then the drawworks drive control signal may direct the drawworks drive 550 to feed cable in or out an amount necessary to restore the current mud motor ΔP to within the input range. In an exemplary embodiment, the drawworks controller 520*b* may be configured to optimize drilling operation parameters related to the mud motor ΔP, such as by maximizing the mud motor ΔP without exceeding the input value or range.

The drawworks controller 520*b* may also or alternatively compare actual ROP data with ROP input data. The actual ROP data is received from the ROP sensor 530*k*, and the ROP input data is received from the corresponding user input 510*k*. The ROP input data received from the user input 510*k* may be a single value indicative of the desired ROP. For example, if the actual ROP differs from the ROP input by a predetermined amount, then the drawworks drive control signal may direct the drawworks drive 550 to feed cable in or out an amount corresponding to the necessary correction of the ROP. However, the ROP input data received from the user input 510*k* may alternatively be a range within which it is desired that the ROP be maintained. For example, if the actual ROP is outside the ROP input range, then the drawworks drive control signal may direct the drawworks drive 550 to feed cable in or out an amount necessary to restore the actual ROP to within the ROP input range. In an exemplary embodiment, the drawworks controller 520*b* may be configured to optimize drilling operation parameters related to the ROP, such as by maximizing the actual ROP without exceeding the ROP input value or range.

The drawworks controller 520*b* may also utilize data received from the toolface controller 520*a* when generating the drawworks drive control signal. Changes in the actual WOB can cause changes in the actual bit torque, the actual mud motor ΔP and the actual toolface orientation. For example, as weight is increasingly applied to the bit, the actual toolface orientation can rotate opposite the direction of drilling, and the actual bit torque and mud motor pressure can proportionally increase. Consequently, the toolface controller 520*a* may provide data to the drawworks controller 520*b* indicating whether the drawworks cable should be fed in or out, and perhaps a corresponding feed rate, as necessary to bring the actual toolface orientation into compliance with the toolface orientation input value or range provided by the corresponding user input 510*h*. In an exemplary embodiment, the drawworks controller 520*b* may also provide data to the toolface controller 520*a* to rotate the quill clockwise or counterclockwise by an amount and/or rate sufficient to compensate for increased or decreased WOB, bit depth, or casing pressure.

As shown in FIG. 5B, the user inputs 510 may also include a pull limit input 510*n*. When generating the drawworks drive control signal, the drawworks controller 520*b* may be configured to ensure that the drawworks does not pull past the pull limit received from the user input 510*n*. The pull limit is also known as a hook load limit, and may be dependent upon the particular configuration of the drilling rig, among other parameters.

In an exemplary embodiment, the drawworks controller 520*b* may also provide data to the toolface controller 520*a* to cause the toolface controller 520*a* to rotate the quill, such as by an amount, direction and/or rate sufficient to compensate for the pull limit being reached or exceeded. The toolface controller 520*a* may also provide data to the drawworks controller 520*b* to cause the drawworks controller 520*b* to increase or decrease the WOB, or to adjust the drill string feed, such as by an amount, direction and/or rate sufficient to adequately adjust the toolface orientation.

Figure 5C:
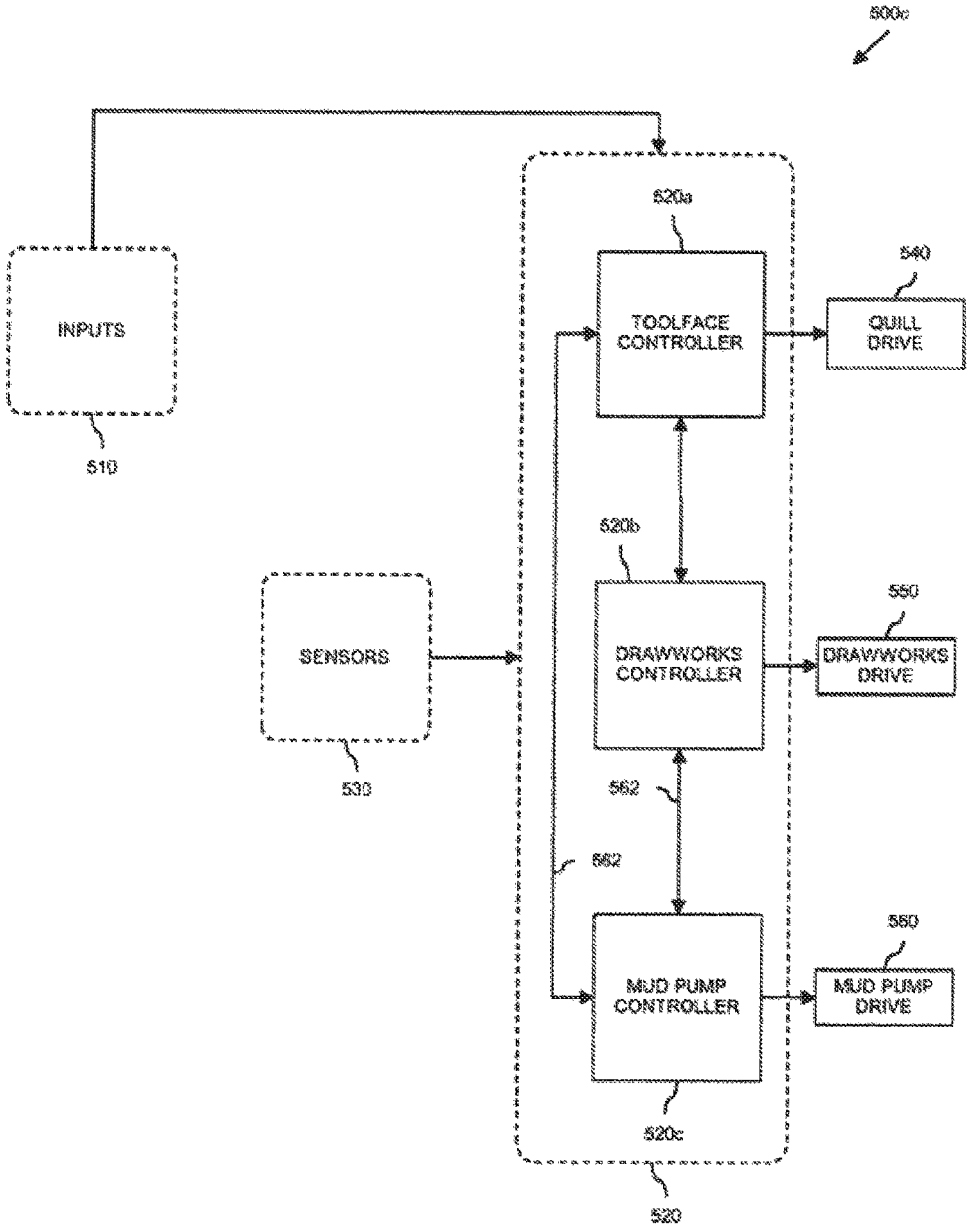
FIG. 5C is a schematic diagram of another embodiment of the apparatus shown in FIGS. 5A and 5B.

Referring to FIG. 5C, illustrated is a schematic view of at least a portion of another embodiment of the apparatus 500*a* and 500*b*, herein designated by the reference numeral 500*c*. Like the apparatus 500*a* and 500*b*, the apparatus 500*c* is an exemplary implementation of the apparatus 100 shown in FIG. 1 and/or the apparatus 400 shown in FIG. 4, and is an exemplary environment in which the method described in FIG. 2 and/or the method described in FIG. 3 may be performed.

Like the apparatus 500*a* and 500*b*, the apparatus 500*c* includes the plurality of user inputs 510 and the at least one processor 520. The at least one processor 520 includes the toolface controller 520*a* and the drawworks controller 520*b*, described above, and also a mud pump controller 520*c*. The apparatus 500*c* also includes or is otherwise associated with the plurality of sensors 530, the quill drive 540, and the drawworks drive 550, like the apparatus 500*a* and 500*b*. The apparatus 500*c* also includes or is otherwise associated with a mud pump drive 560, which is configured to control operation of the mud pump, such as the mud pump 180 shown in FIG. 1. In the exemplary embodiment of the apparatus 500*c* shown in FIG. 5C, each of the plurality of sensors 530 may be located at the surface of the wellbore, downhole (e.g., MWD), or elsewhere.

The mud pump controller 520*c* is configured to generate a mud pump drive control signal utilizing data received from ones of the user inputs 510 and the sensors 530. Thereafter, the mud pump controller 520*c* provides the mud pump drive control signal to the mud pump drive 560, thereby controlling the speed, flow rate, and/or pressure of the mud pump. The mud pump controller 520*c* may form at least a portion of, or may be formed by at least a portion of, the controller 425 shown in FIG. 1.

As described above, the mud motor $\Delta P$ may be proportional or otherwise related to toolface orientation, WOB, and/or bit torque. Consequently, the mud pump controller 520*c* may be utilized to influence the actual mud motor $\Delta P$ to assist in bringing the actual toolface orientation into compliance with the toolface orientation input value or range provided by the corresponding user input. Such operation of the mud pump controller 520*c* may be independent of the operation of the toolface controller 520*a* and the drawworks controller 520*b*. Alternatively, as depicted by the dual-direction arrows 562 shown in FIG. 5C, the operation of the mud pump controller 520*c* to obtain or maintain a desired toolface orientation may be in conjunction or cooperation with the toolface controller 520*a* and the drawworks controller 520*b*.

The controllers 520*a*, 520*b* and 520*c* shown in FIGS. 5A-5C may each be or include intelligent or adaptive controllers, such as neural networks and fuzzy logic. The controllers 520*a*, 520*b* and 520*c* may also be collectively or independently implemented on any conventional or future-developed computing device, such as one or more personal computers or servers, hand-held devices, PLC systems, and/or mainframes, among others.

Figure 6:
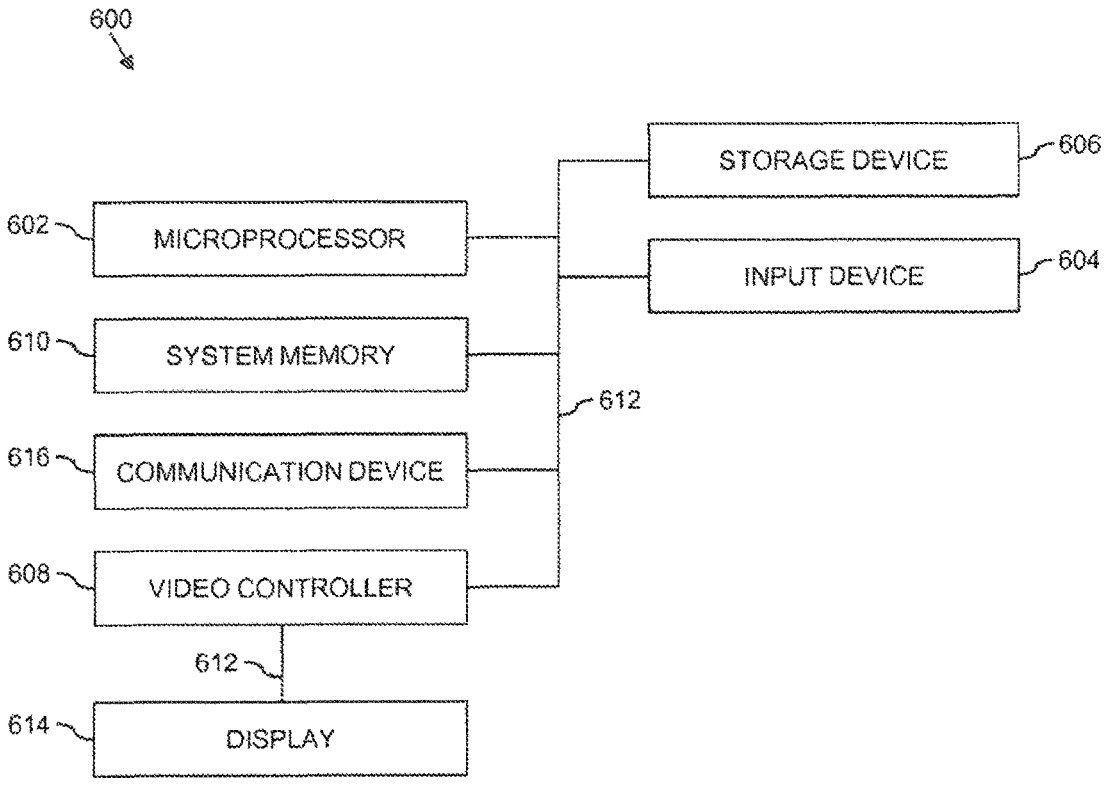
FIG. 6 is a schematic diagram of apparatus according to one or more aspects of the present disclosure.

Referring to FIG. 6, illustrated is an exemplary system 600 for implementing one or more embodiments of at least portions of the apparatus and/or methods described herein. The system 600 includes a processor 602, an input device 604, a storage device 606, a video controller 608, a system memory 610, a display 614, and a communication device 616, all interconnected by one or more buses 612. The storage device 606 may be a floppy drive, hard drive, CD, DVD, optical drive, solid state drive, or any other form of storage device. In addition, the storage device 606 may be capable of receiving a floppy disk, CD, DVD, or any other form of computer-readable medium that may contain computer-executable instructions. Communication device 616 may be a modem, network card, or any other device to enable the system 600 to communicate with other systems.

A computer system typically includes at least hardware capable of executing machine readable instructions, as well as software for executing acts (typically machine-readable instructions) that produce a desired result. Any such software may either be loaded onto the surface control system, within a downhole electronics CPU unit, or distributed between the surface control system and the downhole electronics CPU unit. In addition, a computer system may include hybrids of hardware and software, as well as computer sub-systems.

Hardware generally includes at least processor-capable platforms, such as client-machines (also known as personal computers or servers), and hand-held processing devices (such as smart phones, tablets, PDAs, and personal computing devices (PCDs), for example). Furthermore, hardware typically includes any physical device that is capable of storing machine-readable instructions, such as memory or other data storage devices. Other forms of hardware include hardware sub-systems, including transfer devices such as modems, modem cards, ports, and port cards, for example. Hardware may also include, at least within the scope of the present disclosure, multi-modal technology, such as those devices and/or systems configured to allow users to utilize multiple forms of input and output—including voice, keypads, and stylus—interchangeably in the same interaction, application, or interface.

Software may include any machine code stored in any memory medium, such as RAM or ROM, machine code stored on other devices (such as floppy disks, CDs or DVDs, for example), and may include executable code, an operating system, as well as source or object code, for example. In addition, software may encompass any set of instructions capable of being executed in a client machine or server—and, in this form, is often called a program or executable code.

Hybrids (combinations of software and hardware) are becoming more common as devices for providing enhanced functionality and performance to computer systems. A hybrid may be created when what are traditionally software functions are directly manufactured into a silicon chip—this is possible since software may be assembled and compiled into ones and zeros, and, similarly, ones and zeros can be represented directly in silicon. Typically, the hybrid (manufactured hardware) functions are designed to operate seamlessly with software. Accordingly, it should be understood that hybrids and other combinations of hardware and software are also included within the definition of a computer system herein, and are thus envisioned by the present disclosure as possible equivalent structures and equivalent methods.

Computer-readable mediums may include passive data storage such as a random access memory (RAM), as well as semi-permanent data storage such as a compact disk or DVD. In addition, an embodiment of the present disclosure may be embodied in the RAM of a computer and effectively transform a standard computer into a new specific computing machine.

Data structures are defined organizations of data that may enable an embodiment of the present disclosure. For example, a data structure may provide an organization of data or an organization of executable code (executable software). Furthermore, data signals are carried across transmission mediums and store and transport various data structures, and, thus, may be used to transport an embodiment of the invention. It should be noted in the discussion herein that acts with like names may be performed in like manners, unless otherwise stated.

The controllers and/or systems of the present disclosure may be designed to work on any specific architecture. For example, the controllers and/or systems may be executed on one or more computers, Ethernet networks, local area networks, wide area networks, internets, intranets, hand-held and other portable and wireless devices and networks.

In view of all of the above and FIGS. 1-6, those of ordinary skill in the art should readily recognize that the present disclosure introduces an apparatus for using a quill to steer a hydraulic motor when elongating a wellbore in a direction having a horizontal component, wherein the quill and the hydraulic motor are coupled to opposing ends of a drill string. In an exemplary embodiment, the apparatus may include a drilling tool comprising at least one measurement while drilling (MWD) instrument and a controller communicatively connected to the drilling tool. The controller may be configured to determine a first MWD estimation responsive to a drilling dynamic model associated with the drilling tool, wherein the first MWD estimation is associated with a first timeframe, receive first MWD data from the MWD instrument, wherein the first MWD data is associated with the first timeframe, compare the first MWD estimation and the first MWD data, determine a first error factor responsive to the comparison of the first MWD estimation and the first MWD data, determine a first updated drilling dynamic model responsive to the first error factor, determine a second MWD estimation responsive to the first updated drilling dynamic model, wherein the second MWD estimation is associated with a second timeframe, and provide, to the drilling tool, an output related to at least one operational parameter of the drilling tool.

In certain embodiments, the controller may be further configured to adjust the at least one operational parameter of the drilling tool responsive to the second MWD estimation. The at least one operational parameter may be associated with at least one of a drive torque, a rotational speed, a weight on bit (WOB) of the drilling tool, and a drilling angle of the drilling tool.

In another embodiment, the controller may be further configured to receive second MWD data from the MWD instrument, wherein the second MWD data is associated with the second timeframe, compare the second MWD estimation and the second MWD data, determine a second error factor responsive to the comparison of the second MWD estimation and the second MWD data, determine a second updated drilling dynamic model responsive to the second error factor, and determine a third MWD estimation responsive to the second updated drilling dynamic model, wherein the third MWD estimation is associated with a third timeframe. The controller may also be configured to adjust the at least one operational parameter of the drilling tool responsive to the third MWD estimation.

In another embodiment, the controller may be configured to determine that no MWD data associated with a third timeframe is being received from the MWD instrument, determine a third MWD estimation responsive to the first updated drilling dynamic model, wherein the third MWD estimation is associated with the third timeframe, and adjust the at least one operational parameter of the drilling tool responsive to the third MWD estimation.

In certain embodiments, the first MWD data may include MWD data from a first time period within the first timeframe and the controller may be configured to compare the first MWD data to at least a portion of the first MWD estimation associated with the first time period.

In certain embodiments, wherein the first error factor is further determined responsive to a time delay estimate. The time delay estimate may be associated with a communications time of MWD data transmission and/or a drilling depth of the drilling tool.

In certain embodiments, comparing the first MWD estimation and the first MWD data may include determining a difference between the first MWD estimation and the first MWD data.

In certain embodiments, the controller may be further configured to determine a third MWD estimation responsive to the first updated drilling dynamic model, wherein the third MWD estimation is associated with a third timeframe, receive third MWD data from the MWD instrument, wherein the third MWD data is associated with the third timeframe, compare the third MWD estimation and the third MWD data, determine a third error factor responsive to the comparison of the third MWD estimation and the third MWD data, and determine a third updated drilling dynamic model responsive to the third error factor.

In certain embodiments, the MWD data may be associated with one or more of an pressure, pressure differential, temperature, torque, WOB, vibration, inclination, azimuth, or toolface orientation in three-dimensional space.

In certain embodiments, the first timeframe, the second timeframe, or both, may be a period of at least 10 seconds.

In certain embodiments, the controller may be located at, or split between, the drilling tool and a surface control system.

The present disclosure also introduces a method for using a quill to steer a hydraulic motor when elongating a wellbore in a direction having a horizontal component, wherein the quill and the hydraulic motor are coupled to opposing ends of a drill string. In an exemplary embodiment, the method may include determining a first predicted measurement while drilling (MWD) estimation responsive to a drilling dynamic model associated with a drilling tool, wherein the first MWD estimation is associated with a first timeframe, receiving first MWD data from the drilling tool, wherein the first MWD data is associated with the first timeframe, comparing the first MWD estimation and the first MWD data, determining a first error factor responsive to the comparison of the first MWD estimation and the first MWD data, determining a first updated drilling dynamic model responsive to the first error factor, determining a second MWD estimation responsive to the first updated drilling dynamic model, wherein the second MWD estimation is associated with a second timeframe, and providing, to the drilling tool, an output related to at least one operational parameter of the drilling tool, wherein the output comprises instructions to adjust the at least one operational parameter of the drilling tool responsive to the second MWD estimation.

In certain embodiments, the at least one operational parameter may be associated with at least one of a drive torque, a rotational speed, a weight on bit (WOB) of the drilling tool, and a drilling angle of the drilling tool.

In certain other embodiments, the method may also include receiving second MWD data from the drilling tool, wherein the second MWD data is associated with the second timeframe, comparing the second MWD estimation and the second MWD data, determining a second error factor responsive to the comparison of the second MWD estimation and the second MWD data, determining a second updated drilling dynamic model responsive to the second error factor, and determining a third MWD estimation responsive to the second updated drilling dynamic model, wherein the third MWD estimation is associated with a third timeframe. Additionally, the method may include adjusting the at least one operational parameter of the drilling tool responsive to the third MWD estimation.

In certain embodiments, the first MWD data may include MWD data from a first time period within the first timeframe and comparing the first MWD estimation and the first MWD data may include comparing the first MWD data to at least a portion of the first MWD estimation associated with the first time period.

In certain embodiments, the first error factor may be further determined responsive to a time delay estimate and wherein the time delay estimate is associated with a communications time of MWD data transmission and/or a drilling depth of the drilling tool.

In certain embodiments, comparing the first MWD estimation and the first MWD data may include determining a difference between the first MWD estimation and the first MWD data.

Methods and apparatus within the scope of the present disclosure include those directed towards automatically obtaining and/or maintaining a desired toolface orientation by monitoring drilling operation parameters which previously have not been utilized for automatic toolface orientation, including one or more of actual mud motor ΔP, actual toolface orientation, actual WOB, actual bit depth, actual ROP, actual quill oscillation. Exemplary combinations of these drilling operation parameters which may be utilized according to one or more aspects of the present disclosure to obtain and/or maintain a desired toolface orientation include:

ΔP and TF;
ΔP, TF, and WOB;
ΔP, TF, WOB, and DEPTH;
ΔP and WOB;
ΔP, TF, and DEPTH;
ΔP, TF, WOB, and ROP;
ΔP and ROP;
ΔP, TF, and ROP;
ΔP, TF, WOB, and OSC;
ΔP and DEPTH;
ΔP, TF, and OSC;
ΔP, TF, DEPTH, and ROP;
ΔP and OSC;
ΔP, WOB, and DEPTH;
ΔP, TF, DEPTH, and OSC;
TF and ROP;
ΔP, WOB, and ROP;
ΔP, WOB, DEPTH, and ROP;
TF and DEPTH;
ΔP, WOB, and OSC;
ΔP, WOB, DEPTH, and OSC;
TF and OSC;
ΔP, DEPTH, and ROP;
ΔP, DEPTH, ROP, and OSC;
WOB and DEPTH;
ΔP, DEPTH, and OSC;
ΔP, TF, WOB, DEPTH, and ROP;
WOB and OSC;
ΔP, ROP, and OSC;
ΔP, TF, WOB, DEPTH, and OSC;
ROP and OSC;
ΔP, TF, WOB, ROP, and OSC;
ROP and DEPTH; and
ΔP, TF, WOB, DEPTH, ROP, and OSC;

where ΔP is the actual mud motor ΔP, TF is the actual toolface orientation, WOB is the actual WOB, DEPTH is the actual bit depth, ROP is the actual ROP, and OSC is the actual quill oscillation frequency, speed, amplitude, neutral point, and/or torque.

In an exemplary embodiment, a desired toolface orientation is provided (e.g., by a user, computer, or computer program), and apparatus according to one or more aspects of the present disclosure will subsequently track and control the actual toolface orientation, as described above. However, while tracking and controlling the actual toolface orientation, drilling operation parameter data may be monitored to establish and then update in real-time the relationship between: (1) mud motor ΔP and bit torque; (2) changes in WOB and bit torque; and (3) changes in quill position and actual toolface orientation; among other possible relationships within the scope of the present disclosure. The learned information may then be utilized to control actual toolface orientation by affecting a change in one or more of the monitored drilling operation parameters.

Thus, for example, a desired toolface orientation may be input by a user, and a rotary drive system according to aspects of the present disclosure may rotate the drill string until the monitored toolface orientation and/or other drilling operation parameter data indicates motion of the downhole tool. The automated apparatus of the present disclosure then continues to control the rotary drive until the desired toolface orientation is obtained. Directional drilling then proceeds. If the actual toolface orientation wanders off from the desired toolface orientation, as possibly indicated by the monitored drill operation parameter data, the rotary drive may react by rotating the quill and/or drill string in either the clockwise or counterclockwise direction, according to the relationship between the monitored drilling parameter data and the toolface orientation. If an oscillation mode is being utilized, the apparatus may alter the amplitude of the oscillation (e.g., increasing or decreasing the clockwise part of the oscillation) to bring the actual toolface orientation back on track. Alternatively, or additionally, a drawworks system may react to the deviating toolface orientation by feeding the drilling line in or out, and/or a mud pump system may react by increasing or decreasing the mud motor ΔP. If the actual toolface orientation drifts off the desired orientation further than a preset (user adjustable) limit for a period longer than a preset (user adjustable) duration, then the apparatus may signal an audio and/or visual alarm. The operator may then be given the opportunity to allow continued automatic control, or take over manual operation.

This approach may also be utilized to control toolface orientation, with knowledge of quill orientation before and after a connection, to reduce the amount of time required to make a connection. For example, the quill orientation may be monitored on-bottom at a known toolface orientation, WOB, and/or mud motor ΔP. Slips may then be set, and the quill orientation may be recorded and then referenced to the above-described relationship(s). The connection may then take place, and the quill orientation may be recorded just prior to pulling from the slips. At this point, the quill orientation may be reset to what it was before the connection. The drilling operator or an automated controller may then initiate an "auto-orient" procedure, and the apparatus may rotate the quill to a position and then return to bottom. Consequently, the drilling operator may not need to wait for a toolface orientation measurement, and may not be required to go back to the bottom blind. Consequently, aspects of the present disclosure may offer significant time savings during connections.

The present disclosure is related to and incorporates by reference the entirety of U.S. Pat. No. 6,050,348 to Richardson, et al.

It is to be understood that the disclosure herein provides many different embodiments, or examples, for implementing different features of various embodiments. Specific examples of components and arrangements are described to simplify the present disclosure. These are, of course, merely examples and are not intended to be limiting. In addition, the present disclosure may repeat reference numerals and/or letters in the various examples. This repetition is for the purpose of simplicity and clarity and does not in itself dictate a relationship between the various embodiments and/or configurations discussed. Moreover, the formation of a first feature over or on a second feature in the description that follows may include embodiments in which the first and second features are formed in direct contact, and may also include embodiments in which additional features may be formed interposing the first and second features, such that the first and second features may not be in direct contact.

The foregoing outlines features of several embodiments so that those of ordinary skill in the art may better understand the aspects of the present disclosure. Those of ordinary skill in the art should appreciate that they may readily use the present disclosure as a basis for designing or modifying other processes and structures for carrying out the same purposes and/or achieving some or all of the same advantages of the embodiments introduced herein. Those of ordinary skill in the art should also realize that such equivalent constructions do not depart from the spirit and scope of the present disclosure, and that they may make various changes, substitutions and alterations herein without departing from the spirit and scope of the present disclosure.

The Abstract at the end of this disclosure is provided to comply with 37 C.F.R. § 1.72(b) to allow the reader to quickly ascertain the nature of the technical disclosure. It is submitted with the understanding that it will not be used to interpret or limit the scope or meaning of the claims. Moreover, it is the express intention of the applicant not to invoke 35 U.S.C. § 112(f) for any limitations of any of the claims herein, except for those in which the claim expressly uses the word "means" together with an associated function.

What is claimed is:

1. An apparatus comprising:

a drilling tool comprising at least one measurement while drilling (MWD) instrument; and a controller communicatively connected to the drilling tool and configured to:

determine a first toolface estimation responsive to a drilling dynamic model associated with the drilling tool, wherein the first toolface estimation is associated with a first timeframe;

receive first toolface data from the MWD instrument, wherein the first toolface data is associated with the first timeframe;

compare the first toolface estimation and the first toolface data;

determine a first error factor responsive to the comparison of the first toolface estimation and the first toolface data and responsive to a time delay estimate;

determine a first updated drilling dynamic model responsive to the first error factor;

determine a second toolface estimation responsive to the first updated drilling dynamic model, wherein the second toolface estimation is associated with a second timeframe; and provide, to the drilling tool, an output related to at least one operational parameter of the drilling tool to steer and hold the drilling bit to a desired toolface orientation when slide drilling.

2. The apparatus of claim 1, wherein the controller is further configured to:

adjust the at least one operational parameter of the drilling tool responsive to the second toolface estimation.

3. The apparatus of claim 2, wherein the at least one operational parameter is associated with at least one of a quill position or rate of penetration (ROP) of the drilling tool.

4. The apparatus of claim 1, wherein the controller is further configured to:

receive second toolface data from the MWD instrument, wherein the second toolface data is associated with the second timeframe;

compare the second toolface estimation and the second toolface data;

determine a second error factor responsive to the comparison of the second toolface estimation and the second toolface data;

determine a second updated drilling dynamic model responsive to the second error factor; and determine a third toolface estimation responsive to the second updated drilling dynamic model, wherein the third toolface estimation is associated with a third timeframe.

5. The apparatus of claim 4, wherein the controller is further configured to:

adjust the at least one operational parameter of the drilling tool responsive to the third toolface estimation.

6. The apparatus of claim 1, wherein the controller is further configured to:

determine that no toolface data associated with a third timeframe is being received from the MWD instrument;

determine a third toolface estimation responsive to the first updated drilling dynamic model, wherein the third toolface estimation is associated with the third timeframe; and adjust the at least one operational parameter of the drilling tool responsive to the third toolface estimation.

7. The apparatus of claim 1, wherein the first toolface data comprises toolface data from a first time period within the first timeframe and the controller is configured to compare the first toolface data to at least a portion of the first toolface estimation associated with the first time period.

8. The apparatus of claim 1, wherein the time delay estimate is associated with a communications time of toolface data transmission.

9. The apparatus of claim 1, wherein the time delay estimate is associated with a drilling depth of the drilling tool.

10. The apparatus of claim 1, wherein comparing the first toolface estimation and the first toolface data comprises determining a difference between the first toolface estimation and the first toolface data.

11. The apparatus of claim 1, wherein the controller is further configured to:

determine a third toolface estimation responsive to the first updated drilling dynamic model, wherein the third toolface estimation is associated with a third timeframe;

receive third toolface data from the MWD instrument, wherein the third toolface data is associated with the third timeframe;

compare the third toolface estimation and the third toolface data;

determine a third error factor responsive to the comparison of the third toolface estimation and the third toolface data; and determine a third updated drilling dynamic model responsive to the third error factor.

12. The apparatus of claim 1, wherein the toolface data is associated with one or more of a pressure, pressure differential, temperature, torque, WOB, ROP, vibration, inclination, azimuth, drill string or downhole motor.

13. The apparatus of claim 1, wherein the first timeframe, the second timeframe, or both, is a period of at least 10 seconds.

14. A method comprising:

determining a first predicted toolface estimation responsive to a drilling dynamic model associated with a drilling tool, wherein the first toolface estimation is associated with a first timeframe;

receiving first toolface data from the drilling tool, wherein the first toolface data is associated with the first timeframe;

comparing the first toolface estimation and the first toolface data;

determining a first error factor responsive to the comparison of the first toolface estimation and the first toolface data and responsive to a time delay estimate;

determining a first updated drilling dynamic model responsive to the first error factor;

determining a second toolface estimation responsive to the first updated drilling dynamic model, wherein the second toolface estimation is associated with a second timeframe; and providing, to the drilling tool, an output related to at least one operational parameter of the drilling tool, wherein the output comprises instructions to adjust the at least one operational parameter of the drilling tool responsive to the second toolface estimation to steer and hold a drilling bit to a desired toolface orientation when slide drilling.

15. The method of claim 14, wherein the at least one operational parameter is associated with at least one of a quill position or a rate of penetration (ROP) of the drilling tool.

16. The method of claim 14, further comprising:

receiving second toolface data from the drilling tool, wherein the second toolface data is associated with the second timeframe;

comparing the second toolface estimation and the second toolface data;

determining a second error factor responsive to the comparison of the second toolface estimation and the second toolface data;

determining a second updated drilling dynamic model responsive to the second error factor; and determining a third toolface estimation responsive to the second updated drilling dynamic model, wherein the third toolface estimation is associated with a third timeframe.

17. The method of claim 16, further comprising:

adjusting the at least one operational parameter of the drilling tool responsive to the third toolface estimation.

18. The method of claim 14, wherein the first toolface data comprises toolface data from a first time period within the first timeframe and comparing the first toolface estimation and the first toolface data comprises comparing the first toolface data to at least a portion of the first toolface estimation associated with the first time period.

19. The method of claim 14, wherein the time delay estimate is associated with a communications time of toolface data transmission, a drilling depth of the drilling tool, or both.

20. The method of claim 14, wherein comparing the first toolface estimation and the first toolface data comprises determining a difference between the first toolface estimation and the first toolface data.

21. An apparatus comprising:

a drilling tool comprising at least one measurement while drilling (MWD) instrument; and a controller communicatively connected to the drilling tool and configured to:

determine a first MWD estimation responsive to a drilling dynamic model associated with the drilling tool, wherein the first MWD estimation is associated with a first timeframe;

receive first MWD data from the MWD instrument, wherein the first MWD data is associated with the first timeframe;

compare the first MWD estimation and the first MWD data;

determine a first error factor responsive to the comparison of the first MWD estimation and the first MWD data and responsive to a time delay estimate;

determine a first updated drilling dynamic model responsive to the first error factor;

determine a second MWD estimation responsive to the first updated drilling dynamic model, wherein the second MWD estimation is associated with a second timeframe; and provide, to the drilling tool, an output related to at least one operational parameter of the drilling tool.

* * * * *